US011485560B2

(12) United States Patent
Crosby

(10) Patent No.: US 11,485,560 B2
(45) Date of Patent: Nov. 1, 2022

(54) GUSSETED FLEXIBLE CONTAINER

(71) Applicant: GBS Holdings LLC, Knoxville, TN (US)

(72) Inventor: Bryan Justin Robert Crosby, Knoxville, TN (US)

(73) Assignee: GBS HOLDINGS LLC, Oak Ridge, TN (US)

( * ) Notice: Subject to any disclaimer, the term of this patent is extended or adjusted under 35 U.S.C. 154(b) by 0 days.

(21) Appl. No.: 17/284,675

(22) PCT Filed: Oct. 12, 2018

(86) PCT No.: PCT/US2018/055627
§ 371 (c)(1),
(2) Date: Apr. 12, 2021

(87) PCT Pub. No.: WO2020/076340
PCT Pub. Date: Apr. 16, 2020

(65) Prior Publication Data

US 2021/0354895 A1 Nov. 18, 2021

(51) Int. Cl.
*B65D 47/06* (2006.01)
*B65D 75/00* (2006.01)
*B65D 75/58* (2006.01)

(52) U.S. Cl.
CPC ..... *B65D 75/5877* (2013.01); *B65D 47/063* (2013.01); *B65D 75/008* (2013.01)

(58) Field of Classification Search
CPC . B65D 75/5877; B65D 47/063; B65D 75/008
See application file for complete search history.

(56) References Cited

U.S. PATENT DOCUMENTS 5,307,955 A * 5/1994 Viegas ..... B65D 47/2031 222/173
6,176,394 B1 * 1/2001 Shimko ..... B65D 75/5883 383/41
6,805,261 B1 * 10/2004 Laudenberg ..... B65D 75/5883 222/569
6,883,683 B1 * 4/2005 Cunningham ..... B65D 77/065 383/41
9,550,606 B2 * 1/2017 Crosby ..... B65D 25/48
(Continued)

FOREIGN PATENT DOCUMENTS

EP 3 342 721 A1 3/2018

OTHER PUBLICATIONS

International Search Report and Written Opinion, PCT/US2018/055627, dated Jun. 12, 2019 (22 pp.).

*Primary Examiner* — Frederick C Nicolas
(74) *Attorney, Agent, or Firm* — Eversheds Sutherland (US) LLP

(57) ABSTRACT

Flexible containers are provided herein. In some embodiments, the flexible containers include a front panel, a back panel, a bottom panel, and a top panel attached to form a pourable material storage area, wherein the front panel and the top panel include a hole in the front panel and the top panel to form a dispensing system passage, and wherein the dispensing system passage is not in fluid communication with the pourable material storage area. A dispensing system is attached to the top panel between the top panel and the back panel and extends through the dispensing system passage.

27 Claims, 18 Drawing Sheets

(56) References Cited

U.S. PATENT DOCUMENTS

| | | | | |
|---|---|---|---|---|
| 9,957,148 | B2 * | 5/2018 | Murray | B65D 75/5877 |
| D870,566 | S * | 12/2019 | Crosby | B65D 33/00 D9/708 |
| 2002/0110291 | A1 * | 8/2002 | Edwards | B65D 75/5877 383/104 |
| 2010/0054633 | A1 | 3/2010 | Chang | |
| 2012/0008884 | A1 | 1/2012 | Murray | |
| 2013/0292415 | A1 * | 11/2013 | Stanley | B65D 27/00 222/206 |
| 2015/0158635 | A1 * | 6/2015 | Gum | B65D 75/008 383/38 |
| 2017/0088328 | A1 * | 3/2017 | Franca | B65D 31/04 |
| 2018/0086515 | A1 * | 3/2018 | Ma | B65D 75/566 |
| 2019/0168929 | A1 * | 6/2019 | Crosby | B65D 75/5877 |
| 2021/0171245 | A1 * | 6/2021 | Crosby | B65D 75/5883 |
| 2022/0002058 | A1 * | 1/2022 | Murray | B65D 75/5883 |

* cited by examiner

GUSSETED FLEXIBLE CONTAINER

CROSS-REFERENCE TO RELATED APPLICATION

This application is a national stage application under 35 U.S.C. § 371 of International Application No. PCT/US2018/055627, filed Oct. 12, 2018, the entire disclosure of which is hereby incorporated herein by reference.

FIELD OF THE DISCLOSURE

The present disclosure relates generally to containers, more particularly, to flexible containers for dispensing a fluid.

BACKGROUND

Flexible containers are considered particularly advantageous forms of packaging for fluids, because they are lighter than their rigid counterparts, and produce a smaller volume of waste once the empty container is disposed by a consumer.

Additionally, flexible containers advantageously allow a user to empty more of a viscous fluid from the flexible container than from a rigid container. However, it can be particularly difficult for consumers to open and dispense from flexible containers. For example, users often spill the contents of flexible containers while opening them, or while dispensing them, because the pressure of a user's grip on the flexible container during these activities can cause unintended flow of the fluid within the flexible container through the package opening and out of the package. As is described in International Patent Application No. PCT/US18/63195, filed on Nov. 30, 2018, which is hereby incorporated herein by reference in its entirety, improved fitments and pouring spouts for flexible containers may facilitate the easy and clean transfer of pourable materials from flexible containers.

However, these advantageous dispensing systems, such as the dispensing systems described in U.S. Pat. No. 10,589,908, filed on Dec. 1, 2017, the entirety of which is incorporated herein by reference, protrude significantly from the package surface. Thus, the protrusion of the dispensing systems significantly increases the height or depth of the flexible container compared to a traditional fitment or closure. As a result, fewer of the flexible containers as described in U.S. Pat. No. 10,589,908 can be fit on a standard store shelf or in a standard shipping container than flexible containers with a traditional fitment or closure, or the flexible containers must be smaller in one or more dimensions to account for the protrusion of the dispensing system, so that the flexible containers contain less pourable material than flexible containers with a traditional fitment or closure.

Accordingly, there is a need for an improved flexible container design suitable for receiving dispensing systems which facilitate the easy and clean transfer of pourable materials from flexible containers.

SUMMARY

A flexible container is provided, comprising: a front panel having an inner surface and an outer surface, a first longitudinal edge portion, a second longitudinal edge portion, a top horizontal edge portion, and a bottom horizontal edge portion; a back panel having an inner surface and an outer surface, wherein the inner surface of the back panel is attached to the inner surface of the front panel, a first longitudinal edge portion, a second longitudinal edge portion, a top horizontal edge portion, and a bottom horizontal edge portion; a bottom panel having an inner surface and an outer surface, a first longitudinal edge portion, a second longitudinal edge portion, a first horizontal edge portion, and a second horizontal edge portion, wherein the inner surface of the bottom panel is attached to the inner surface of the front panel and the inner surface of the back panel, such that at least a portion of the bottom panel extends between the front panel and the back panel; a top panel having an inner surface and an outer surface, a first longitudinal edge portion, a second longitudinal edge portion, a first horizontal edge portion, and a second horizontal edge portion, wherein the inner surface of the top panel is attached to the inner surface of the front panel and the inner surface of the back panel, such that at least a portion of the top panel extends between the front panel and the back panel opposite the bottom panel, wherein the inner surfaces of the front panel, the back panel, the bottom panel, and the top panel form a pourable material storage area, wherein the front panel and the top panel comprise a hole in the front panel and the top panel to form a dispensing system passage, wherein the dispensing system passage is not in fluid communication with the pourable material storage area; and a dispensing system in fluid communication with the pourable material storage area and attached to the top panel between the top panel and the back panel and extending through the dispensing system passage.

DETAILED DESCRIPTION

Figure 1:
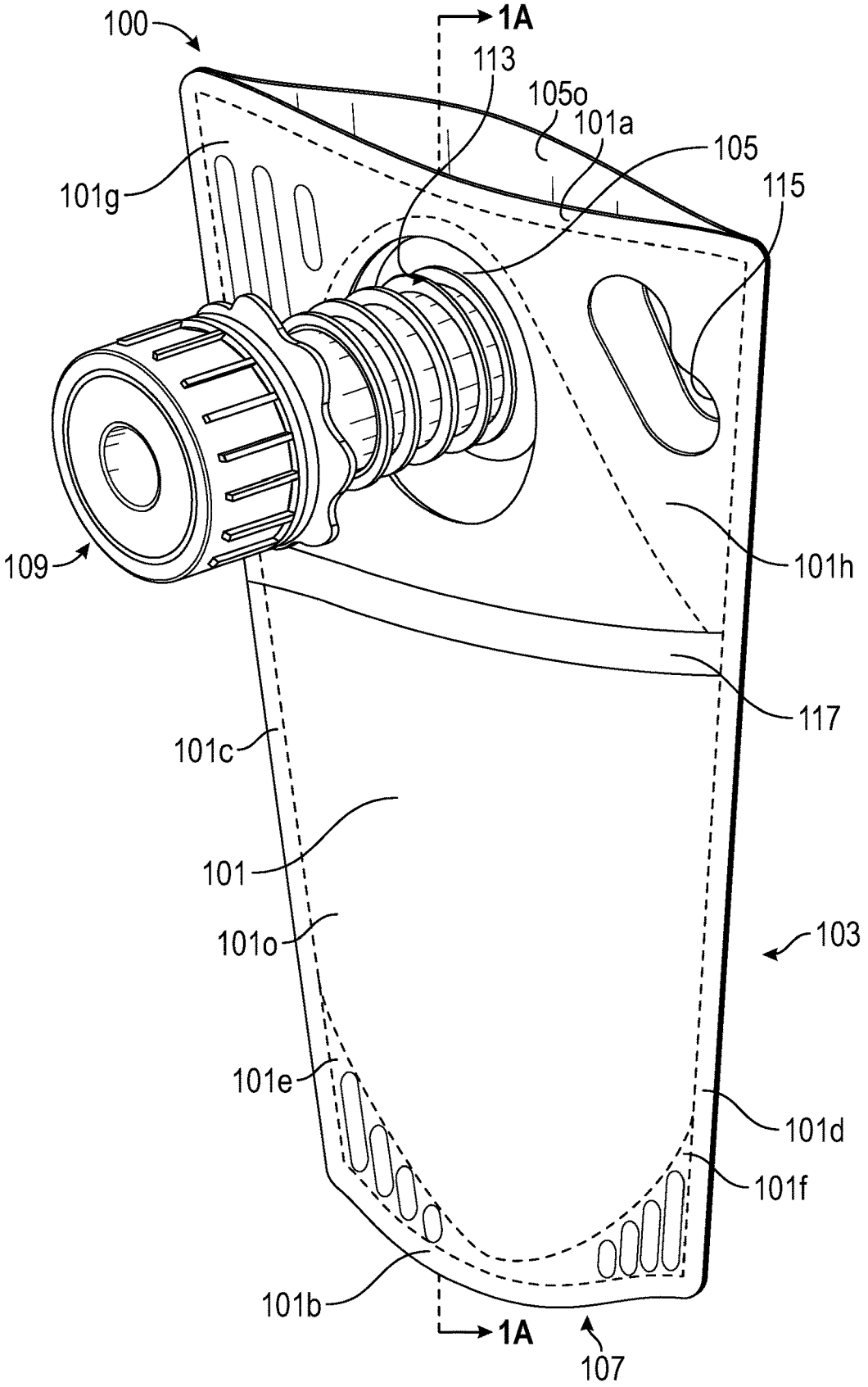
FIG. 1 is a perspective view of a flexible container and dispensing system according to an embodiment of the present disclosure, wherein the flexible container is filled with a fluid.

In the following description, numerous specific details are given to provide a thorough understanding of several embodiments. The embodiments can be practiced without one or more of the specific details, or with other components, materials, etc. In other instances, well-known structures, materials, or operations are not shown or described in detail in order to avoid obscuring aspects of the described embodiments.

Reference throughout this specification to "one embodiment," "an embodiment," or "embodiments" means a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used herein, "flexible container" means a container which is easily bendable or deformed between a variety of shapes. In some embodiments, the flexible container may be substantially flat before being filled with a material and assuming a three-dimensional shape. In these embodiments, the flexible container may advantageously return to a substantially flat, flexible shape for disposal once the material is emptied.

Flexible Containers

In some embodiments, flexible containers including a front panel, a back panel, a bottom panel, and a top panel are provided. In some embodiments, the front panel has an inner surface and an outer surface, a first longitudinal edge portion, a second longitudinal edge portion, a top horizontal edge portion, and a bottom horizontal edge portion. In some embodiments, the back panel has an inner surface and an outer surface. In some embodiments, the bottom panel has an inner surface and an outer surface, a first longitudinal edge portion, a second longitudinal edge portion, a first horizontal edge portion, and a second horizontal edge portion. In some embodiments, the top panel has an inner surface and an outer surface, a first longitudinal edge portion, a second longitudinal edge portion, a first horizontal edge portion, and a second horizontal edge portion. In some embodiments, one or more of the front panel, back panel, bottom panel, and top panel may be integrally formed from a single flexible material. In these embodiments, one or more of the edge portions may be continuous. For example, if the front panel and the back panel are integrally formed, the first longitudinal edge portions of the front panel and the back panel may be continuous. In some embodiments, one or more of the front panel, back panel, bottom panel, and top panel may be separate pieces of flexible materials which are then attached or joined to form the flexible container.

In some embodiments, the back panel includes a first longitudinal edge portion, a second longitudinal edge portion, a top horizontal edge portion, and a bottom horizontal edge portion. In some embodiments, the inner surface of the back panel is attached to the inner surface of the front panel. In some embodiments, the inner surface of the bottom panel is attached to the inner surface of the front panel and the inner surface of the back panel, such that at least a portion of the bottom panel extends between the front panel and the back panel. In some embodiments, the inner surface of the top panel is attached to the inner surface of the front panel and the inner surface of the back panel, such that at least a portion of the top panel extends between the front panel and the back panel opposite the bottom panel. In some embodiments, the inner surfaces of the front panel, the back panel, the bottom panel, and the top panel form a pourable material storage area. In some embodiments, the front panel and the top panel comprise a hole in the front panel and the top panel to form a dispensing system passage, wherein the dispensing system passage is not in fluid communication with the pourable material storage area.

In some embodiments, the front panel, the back panel, the bottom panel, and the top panel may have a variety of shapes to form a flexible container such that the flexible container and its pourable material storage area may have a variety of shapes. In some embodiments, the front panel and back panel are polygonal in shape when the pourable material storage area is empty. In some embodiments, the top panel and bottom panel are polygonal in shape when the pourable material storage area is empty. In some embodiments, each of the front panel, back panel, top panel, and bottom panel are polygonal in shape when the pourable material storage area is empty. For example, in some embodiments, the front panel and back panel are substantially rectangular in shape when the pourable material storage area is empty. In some embodiments, the top panel and bottom panel are substantially rectangular in shape when the pourable material storage area is empty. In some embodiments, each of the front panel, back panel, top panel, and bottom panel are substantially rectangular in shape when the pourable material storage area is empty. In some embodiments, the front panel and back panel are substantially elliptical in shape when the pourable material storage area is empty. In some embodiments, the top panel and bottom panel are substantially elliptical in shape when the pourable material storage area is empty. In some embodiments, each of the front panel, back panel, top panel, and bottom panel are substantially elliptical in shape when the pourable material storage area is empty. In some embodiments, the front panel and back panel are hexagonal in shape when the pourable material storage area is empty. In some embodiments, the top panel and bottom panel are hexagonal in shape when the pourable material storage area is empty. In some embodiments, each of the front panel, back panel, top panel, and bottom panel are hexagonal in shape when the pourable material storage area is empty.

In some embodiments, the top horizontal edge portion of the front panel is attached to the first horizontal edge portion of the top panel. In some embodiments, the top horizontal edge portion of the back panel is attached to the second horizontal edge portion of the top panel. In some embodiments, the first longitudinal edge portion of the front panel is attached to the first longitudinal edge portion of the back panel. In some embodiments, the second longitudinal edge portion of the front panel is attached to the second longitudinal edge portion of the back panel. In some embodiments, the bottom horizontal edge portion of the front panel is attached to the first horizontal edge portion of the bottom panel. In some embodiments, the bottom horizontal edge portion of the back panel is attached to the second horizontal edge portion of the bottom panel. Accordingly, in some embodiments, the pourable material storage area is formed by the area between these attached edge portions.

In some embodiments, the inner surfaces of the front panel and the top panel are sealed at a spaced apart distance from the top horizontal edge portion of the top panel to form a front seal. Accordingly, in some embodiments, the pourable material storage area is formed by the area between the front seal and the attached edge portions. In other words, in some embodiments, the pourable material storage area does not include the area between the top horizontal edge portion of the front panel and the front seal, or the area between the first horizontal edge portion of the top panel and the front seal.

In some embodiments, the hole forming a handle is between the top horizontal edge portion of the top panel and the front seal. In some embodiments, the hole is substantially circular in shape. In some embodiments, the hole is substantially elliptical in shape. In some embodiments, the hole is fabiform. In some embodiments, the hole is polygonal in shape. In some embodiments, including, but not limited to larger embodiments, the flexible container may further comprise a handle or carrying piece attached to the flexible container.

In some embodiments, the outer surface of the bottom panel is attached to itself along each of the first longitudinal edge portion and the second longitudinal edge portion. In these embodiments, the bottom panel may be folded along a crease centered between the first horizontal edge portion and the second horizontal edge portion of the bottom panel when the pourable material storage area is empty. For example, in some embodiments, the bottom panel may be folded along a crease parallel to the first horizontal edge portion and the second horizontal edge portion of the bottom panel when the pourable storage area is empty. In this way, when the pourable material storage area is filled with a fluid or other pourable material, the crease may at least partially unfold, allowing the flexible container to expand by allowing the front panel and the back panel to curve around a longitudinal axis and allowing the bottom horizontal edge portions of the front and back panels to move away from one another.

In some embodiments, the outer surface of the top panel is attached to itself along each of the first longitudinal edge portion and the second longitudinal edge portion. In these embodiments, the top panel may be folded along a crease centered between the first horizontal edge portion and the second horizontal edge portion of the top panel when the pourable material storage area is empty. For example, in some embodiments, the top panel may be folded along a crease parallel to the first horizontal edge portion and the second horizontal edge portion of the top panel when the pourable storage area is empty. In this way, when the pourable material storage area is filled with a fluid or other pourable material, such as a pourable solid particulate material, the crease may at least partially unfold, allowing the flexible container to expand by allowing the front panel and the back panel to curve around a longitudinal axis and allowing the top horizontal edge portions of the front and back panels to move away from one another. In other words, the top panel may form an expandable gusset.

In some embodiments, the front panel further includes a first corner seal portion extending between the first longitudinal edge portion and the bottom horizontal edge portion of the front panel, and a second corner seal portion extending between the second longitudinal edge portion and the bottom horizontal edge portion of the front panel. In some embodiments, the bottom panel further includes a first front corner seal portion extending between the first horizontal edge portion and the first longitudinal edge portion, and a second front corner seal portion extending between the front horizontal edge portion and the second longitudinal edge portion. In some embodiments, the inner surface of the front panel at the first top corner seal portion is attached to the inner surface of the top panel at the first front corner seal portion and the inner surface of the back panel at the second top corner seal portion is attached to the inner surface of the top panel at the second back corner seal portion.

In some embodiments, the back panel further includes a first corner seal portion extending between the first longitudinal edge portion and the bottom horizontal edge portion of the back panel, and a second corner seal portion extending between the second longitudinal edge portion and the bottom horizontal edge portion of the back panel. In some embodiments, the bottom panel further includes a first back corner seal portion extending between the second horizontal edge portion and the first longitudinal edge portion, and a second front corner seal portion extending between the second horizontal edge portion and the second longitudinal edge portion. In some embodiments, the inner surface of the back panel at the first corner seal portion is attached to the inner surface of the bottom panel at the first back corner seal portion and the inner surface of the back panel at the second corner seal portion is attached to the inner surface of the bottom panel at the second back corner seal portion.

In some embodiments, the front panel further includes a first top corner seal portion extending between the first longitudinal edge portion and the top horizontal edge portion of the front panel, and a second top corner seal portion extending between the second longitudinal edge portion and the top horizontal edge portion of the front panel. In some embodiments, the top panel further includes a first front corner seal portion extending between the first horizontal edge portion and the first longitudinal edge portion, and a second front corner seal portion extending between the first horizontal edge portion and the second longitudinal edge portion. In some embodiments, the inner surface of the front panel at the first top corner seal portion is attached to the inner surface of the top panel at the first front corner seal portion and the inner surface of the front panel at the second top corner seal portion is attached to the inner surface of the top panel at the second front corner seal portion.

In some embodiments, the back panel further includes a first top corner seal portion extending between the first longitudinal edge portion and the bottom horizontal edge portion of the back panel, and a second top corner seal portion extending between the second longitudinal edge portion and the bottom horizontal edge portion of the back panel. In some embodiments, the top panel further includes a first back corner seal portion extending between the second horizontal edge portion and the first longitudinal edge portion, and a second back corner seal portion extending between the second horizontal edge portion and the second longitudinal edge portion. In some embodiments, the inner surface of the back panel at the first top corner seal portion is attached to the inner surface of the top panel at the first back corner seal portion and the inner surface of the back panel at the second top corner seal portion is attached to the inner surface of the top panel at the second back corner seal portion.

In some embodiments, the corner seal portions are configured such that, when the pourable material storage area is filled with a fluid, the bottom longitudinal horizontal edge portion of the front panel and the bottom longitudinal horizontal edge portion of the back panel form a substantially elliptical shape. In some embodiments, the corner seal portions are linear. For example, in some embodiments, the portions of the front panel and the back panel which form the pourable material storage area are substantially polygonal in shape, for example hexagonal or octagonal in shape. In some embodiments, the corner seal portions are curved. For example, in some embodiments, the portions of the front panel and the back panel which form the pourable material storage area are substantially circular or substantially elliptical in shape.

In some embodiments, one or more of the front panel, the back panel, the top panel, and the bottom panel is made from a suitable single-layer or multi-layer film. In some embodiments, each of the front panel, the back panel, the top panel, and the bottom panel is made from a suitable single-layer or multi-layer film. In some embodiments, one or more of the front panel, the back panel, the top panel, and the bottom panel is made from polyolefins. In some embodiments, each of the front panel, the back panel, the top panel, and the bottom panel is made from polyolefins. For example, in some embodiments each of the front panel, the back panel, the top panel, and the bottom panel comprises a flexible plastic.

In some embodiments, one or more or all of the front panel, the back panel, the top panel, and the bottom panel comprise a liquid or gas barrier additive or film to hinder or prevent passage of gas or liquid or both in or out of the flexible package. Such barrier additives or films are known to those skilled in the art. In some embodiments, such additives may be incorporated into the flexible material from which the panels are made or barrier films or layers may be laminated to or coextruded with one or more other flexible layers to form the panels. In some embodiments, the barrier layer comprises an inner layer of the flexible package. In some embodiments, the barrier layer comprises a metal film or foil or is a vapor deposited layer.

In some embodiments, one or more of the top panel, the bottom panel, the front panel, and the back panel are attached to each other by a bonding method or a combination of bonding methods. Non-limiting examples of suitable bonding methods include adhesive gluing, sonic welding, heat sealing, and the like.

In some embodiments, the flexible container includes a dispensing system attached to the top panel between the top panel and the back panel and extending through the dispensing system passage. For example, the flexible container may include a dispensing system as described in any of U.S. Pat. No. 9,550,606, International Patent Application No. PCT/US18/63195, or U.S. Pat. No. 10,589,908, each of which is incorporated herein by reference in its entirety.

In some embodiments, the dispensing system passage allows the dispensing system to extend through it both when the pourable material storage area is empty and when the pourable material storage area is filled with a fluid or other pourable material. In this way, the dispensing system extends substantially less from the outer surface of the front panel when the pourable material storage area is filled with a fluid or other pourable material than it would if the dispensing system were attached to the front panel. This advantageously reduces the depth of the flexible container, allowing more flexible containers of a given volume to fit on a store shelf, shipping container, or any area of a fixed volume than prior art flexible containers of the same volume with the dispensing systems.

In some embodiments, when the pourable material storage area is filled with a fluid, the dispensing system does not horizontally extend beyond a vertical plane tangential to the outer surface of the front panel by more than about 1.5 inches. For example, in some embodiments, when the pourable material storage area is filled with a fluid, the dispensing system does not horizontally extend beyond a vertical plane tangential to the outer surface of the front panel by more than about 1.5 inches, about 1.25 inches, about 1.0 inches, about 0.75 inches, about 0.5 inches, about 0.25 inches, or any ranges therebetween. In some embodiments, when the pourable material storage area is filled with a fluid, the dispensing system does not horizontally extend beyond a vertical plane tangential to the outer surface of the front panel.

Dispensing Systems for Flexible Containers

In some embodiments, the dispensing system includes a fitment and a detachable dispensing system. For example, in some embodiments the fitment includes a canoe comprising a body having an outer surface and an inner surface defining a passage extending through the body, wherein the outer surface of the canoe is configured to be attached to the inner surface of the top panel and an engaging element attached to the canoe and surrounding a dispensing opening and configured to engage a detachable dispensing system. In some embodiments, the engaging element may be configured to provide a friction or snap interference fit, or to threadingly engage the detachable dispensing system. In some embodiments, the detachable dispensing system includes a handling portion comprising an outer ring configured to selectively secure and remove the handling portion about the engaging element and an inner ring defining a circular aperture within the handling portion; a hollow rigid member comprising a top end and a base end, the top end comprising a first engaging element for engaging at least a portion of the inner ring of the handling portion and preventing the top end of the hollow rigid member from moving through the handling portion into the container when the hollow rigid member is in the recessed position, and the base end comprising a second engaging element, which comprises first one or more peripheral elements that extend outwardly from the hollow rigid member, for engaging at least a portion of the inner ring of the handling portion and fixing the hollow rigid member to the handling portion when the hollow rigid member is in the extended position. In some embodiments, the hollow rigid member is slideably disposed within the circular aperture and selectively positionable between: (a) a recessed position, wherein the top end is proximate the handling portion and the base end extends away from the handling portion and toward the container and (b) an extended position in which the base end is proximate the handling portion and the top end extends away from the handling portion and the container. In some embodiments, the dispensing system further includes an extendible spout at least partially disposed in the hollow rigid member and connected to the hollow rigid member, the extendible spout including: a proximal end and a proximal opening, the proximal end connected to the hollow rigid member, a distal end and a distal opening, the distal end configured to extend from and retract at least partially into the hollow rigid member, and a discharge passage that extends from the proximal opening to the distal opening. In some embodiments, the extendible spout is configured to dispense a pourable material from the container through the distal opening when the handling portion is engaged about the dispensing opening of the container.

In some embodiments, the dispensing system further includes a removable lid configured to attach to the handling portion and configured to cover the top end of the hollow rigid member when the hollow rigid member is in the recessed position.

In some embodiments, the canoe is configured to be welded or glued to the inner surface of the top panel.

In some embodiments, the dispensing system includes a fitment including: (1) a hollow canoe portion having an outer surface and an inner surface defining a passage extending through the body, wherein the canoe is configured to be attached to an inner surface of the flexible container; and (2) a hollow rigid member at least partially disposed within the hollow canoe portion, the hollow rigid member comprising a top end having a discharge opening and a base end, the base end extending from the hollow canoe portion toward the flexible container. In some embodiments, the fitment further includes (3) an extendible spout at least partially disposed in the hollow rigid member and connected to the hollow rigid member. In some embodiments, the extendible spout includes: a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening. In some embodiments, the extendible spout is configured to dispense a pourable material from the flexible container through the distal opening when the hollow canoe portion is attached to the inner surface of the flexible container.

In some embodiments, the flexible container includes a hollow friction fitting attached to the inner surface of the top panel. In some embodiments, the hollow friction fitting is configured to be welded or glued to the inner surface of the front panel. In some embodiments, the outer surface of the hollow canoe portion is configured to be attached to the inner surface of the hollow friction fitting.

In some embodiments, the dispensing system includes a pouring spout fitment, including: (1) a hollow rigid member comprising a top end having a discharge opening and a base end having a base end opening, an inner surface defining an inner space extending between the discharge opening and the base end opening, and an outer surface; and (2) an extendible spout at least partially disposed in the hollow rigid member and connected to the hollow rigid member, the extendible spout comprising: a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening. In some embodiments, the outer surface comprises friction fit attachment means configured to attach to a friction fit opening in the flexible container. In some embodiments, the extendible spout is configured to dispense a pourable material from the container through the distal opening when the hollow rigid member is attached to the friction fit opening.

In some embodiments, the hollow rigid member further comprises a removable lid adapted to removably cover the discharge opening of the hollow rigid member.

In some embodiments, the removable lid further includes a first sealing flange which engages with the top end of the hollow member to form a seal between the removable lid in the closed position and the hollow member; and a second sealing flange which engages with the distal end of the extendible spout to form a seal between the removable lid in the closed position and the extendible spout. In these embodiments, the removable lid may advantageously prevent the pourable material from exiting the extendible spout when the lid is closed.

Dispensing Systems for Flexible Containers

Dispensing systems suitable for use with the flexible containers described herein may take many different forms. For example, in some embodiments, the dispensing system is merely a standard fitment with a removable cap. However, in some embodiments, the dispensing system may be a detachable dispensing system, a pouring spout fitment dispensing system, or a friction fit pouring spout fitment dispensing system.

Detachable Dispensing Systems

In some embodiments, dispensing systems for flexible containers are provided. These dispensing systems for flexible containers include a fitment and a detachable dispensing system. Embodiments of suitable detachable dispensing systems are described in detail in U.S. Pat. No. 9,550,606, which is hereby incorporated by reference herein in its entirety.

Fitments suitable for use with dispensing systems for flexible containers disclosed herein may include a canoe including a body having an outer surface and an inner surface defining a passage extending through the body, wherein the canoe is configured to be attached to the inner surface of a flexible package. The canoe may be any suitable size or shape for the flexible package, and is typically larger than the dispensing opening of the dispensing system. For example, the canoe may have an oblong boat-like shape, and may substantially surround a dispensing opening. In other embodiments, the canoe may have a cylindrical shape. In other embodiments, the canoe may have a relatively flat, circular shape. The canoe may be attached to the inner surface of a flexible package by welding, glue, adhesive, or any suitable attachment means.

In some embodiments, the fitment also includes a rail grabber portion. The rail grabber portion may be attached to the canoe portion. For example, the rail grabber portion may be located above the canoe portion, such that the rail grabber portion extends beyond the flexible container when the canoe portion is attached to the inner surface of a flexible container. In some embodiments, the rail grabber portion substantially surrounds at least a portion of the hollow rigid member. In some embodiments, the rail grabber portion may consist of two or more protrusions which extend outward around a dispensing opening. The rail grabber portion is configured to allow for easy transport of the fitment and flexible package with the fitment attached along standard manufacturing lines, according to methods which are known in the art.

In some embodiments, the fitment also includes attachment means configured to allow the detachable dispensing system to be selectively attached to the fitment and removed from the fitment. In some embodiments, the attachment means are threads. In some embodiments, the attachment means include at least one snapping element.

In some embodiments, the detachable dispensing system includes a handling portion having an outer ring and an inner ring. The outer ring is configured to selectively secure and, alternatively, remove the handling portion about a dispensing opening of the fitment. That is, the outer ring connects the handling portion to the container. The outer ring configuration advantageously enables the handling portion, and thus the system, to be attached to and removed from the fitment, when desired, rather than being permanently attached. As a result, the systems described herein can be repeatedly used with the same container or other containers, thereby allowing the containers to be resealed with its initial lid and/or seal after each allotment of pourable materials via the system or the container may be discarded. This feature minimizes contamination and spillage of the pourable material within the container between each allotment. The outer ring configuration also beneficially secures the system to the container so that unwanted spillage of the pourable material is minimized, if not avoided, during use and to prevent the pourable material of the container to be exposed to the environment when being dispensed therefrom.

In some embodiments, the handling portion is made of a thermoplastic material. Non-limiting examples of suitable thermoplastic materials include polypropylene, polyethylene, and the like. In some embodiments, the handling portion is formed by injection molding.

In embodiments, the detachable dispensing systems described herein also include a hollow rigid member that includes a top end and a base end. In some embodiments, the hollow rigid member is fixed within the handling portion. In other embodiments, the hollow rigid member is slideably disposed within the handling portion and selectively positionable between a recessed position and an extended position.

As used herein, "slideably disposed" means that the hollow rigid member is freely moveable through the handling portion unless otherwise fixed to the handling portion when in a recessed position or an extended position.

As used herein, "selectively positionable" when used to describe the hollow rigid member means capable of being moved and positioned, e.g. by a user, from a recessed position to an extended position and vice versa at desired times.

In some embodiments, the hollow rigid member is made of a thermoplastic material. Non-limiting examples of suitable thermoplastic materials include polypropylene, polyethylene, and the like. In some embodiments, the hollow rigid member is formed by injection molding.

In operation, when the hollow rigid member is in the extended position, the base end of the hollow rigid member, in some embodiments, may be substantially flush with the dispensing opening of the fitment, whereas in other embodiments, the base end may be substantially flush with the inner ring of the handling portion. As used herein, the term "flush" when used to describe the position of the base end of the hollow rigid member in relation to another component of the detachable dispensing system means immediately adjacent to or directly abutting such component. In an embodiment, when the hollow rigid member is in the extended position, the hollow rigid member may be partially disposed within the container. For example, in one embodiment, at least a portion of the base end of the hollow rigid member may be partially disposed within the container above the fill line for the pourable material. In some embodiments, the hollow rigid member has one or more protrusions at its base end to prevent the base end of the hollow rigid member from extending beyond the dispensing opening of the fitment. For example, in some embodiments, the hollow rigid member may have a base end which is flared, such that the diameter of the base end is larger than the diameter of the top end of the hollow rigid member. In embodiments where the hollow rigid member has a base end which is flared, the hollow rigid member may advantageously easily form a seal with the inner ring of the handling portion, even accounting for variations in the inner diameter of the inner ring of the handling portion. For example, because the base end is flared, it can form a seal with the inner ring of the handling portion even if the inner ring of the handling portion is slightly larger than its designed dimension.

In some embodiments, the detachable dispensing system also includes an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the flexible package through the distal opening when the handling portion is engaged about the dispensing opening of the fitment, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the flexible package to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer. In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the detachable dispensing systems with the ability to dispense material from a container into various destinations without having to disconnect the system from the container.

In one embodiment, a user may insert a finger or tool into the distal end of the extendible spout to adjust the extendible spout from one extended length to a second extended length, when desired.

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the detachable dispensing system includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the detachable dispensing system includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the detachable dispensing system includes a removable lid that covers the top end of the hollow rigid member, when the hollow rigid member is in the recessed position. In one embodiment, the removable lid is hingedly connected to the hollow rigid member. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit. In another embodiment, the removable lid includes inner one or more threads configured to engage the outer one or more threads that are disposed on the outer periphery of the handling portion.

In some embodiments, the removable lid includes one or more sealing flanges configured to form a seal between the removable lid and the hollow member or extendible spout. For example, in some embodiments the removable lid includes a first sealing flange configured to engage the top end of the hollow member to form a seal between the removable lid and the hollow member when the removable lid is in the closed position. In some embodiments, the removable lid includes a second sealing flange configured to engage the distal end of the extendible spout to form a seal between the removable lid and the extendible spout when the removable lid is in a closed position. The two sealing flanges may offer additional security against the leaking or unintended pouring of the contents of the flexible package. Further, the second sealing flange may prevent the contents of the flexible package from leaking onto the exterior of the extendible spout. In this way, the outer surface of the extendible spout, which is likely to be grasped by a user seeking to pour the contents of the flexible package, may be kept clean even if the extendible spout is extended and retracted. In other words, a user may be able to use only a portion of the contents of the flexible package, re-close the package, and still find the extendible spout suitable for use upon re-opening the flexible package. In some embodiments, the second sealing flange is a dome-shaped protrusion. In these embodiments, the second sealing flange may advantageously serve as a self-centering feature, to center the distal opening of the extendible spout about the second sealing flange, so that the distal opening of the extendible spout can be sealed by the second sealing flange merely by closing the lid.

Pouring Spout Fitments

In some embodiments, the dispensing system is a pouring spout fitment. In some embodiments, the fitments may include a canoe comprising a body having an outer surface and an inner surface defining a passage extending through the body, wherein the canoe is configured to be attached to the inner surface of the top panel. The canoe may be any suitable size or shape for the flexible container, and is typically larger than the dispensing opening of the dispensing system. For example, the canoe may have an oblong boat-like shape, and may substantially surround a dispensing opening. In other embodiments, the canoe may have a cylindrical shape. In other embodiments, the canoe may have a polygonal shape. The canoe may be attached to the inner surface of the top panel by welding, glue, adhesive, or any suitable attachment means.

In some embodiments, the pouring spout fitment further include a hollow rigid member, at least partially disposed within the hollow canoe portion. That is, at least a portion of the hollow rigid member may be within the hollow canoe portion. The hollow rigid member may include a top end, which has a discharge opening, and a base end having a base opening, where the base opening and the discharge opening are in fluid communication with one another. In some embodiments, the base end of the hollow rigid member may extend below the hollow canoe portion. In some embodiments, there may be an annular space created between the outer surface of the hollow rigid member and the inner surface of the hollow canoe portion. This annular space may advantageously assist in preventing unwanted spillage from the flexible container. For example, users often struggle with dispensing fluids from flexible containers, because the pressure imparted by a user's grasp of the container can cause the fluid contained within it to flow out of the dispensing opening, particularly during opening of the container, when additional pressure may be applied by a user. In embodiments where this annular space is present, however, the material in the flexible container can flow into this annular space, such that there is less likelihood of spillage through the dispensing opening. In some embodiments, the outer surface of the hollow rigid member may be connected to the hollow canoe portion, so that no annular space is created. In these embodiments, it may be advantageously easier for a user to empty the entirety of the contents of the flexible container.

In some embodiments, the pouring spout fitment also includes a rail grabber portion. The rail grabber portion may be attached to the canoe portion. For example, in some embodiments, the rail grabber portion may be located above the canoe portion, or away from the flexible container, such that the rail grabber portion extends beyond the flexible container when the canoe portion is attached to the inner surface of the top panel. In some embodiments, the rail grabber portion substantially surrounds at least a portion of the hollow rigid member. In some embodiments, the rail grabber portion may consist of two or more protrusions which extend outward around a dispensing opening. The rail grabber portion is configured to allow for easy transport of the fitment and flexible container with the fitment attached along standard manufacturing lines, according to methods which are known in the art.

In some embodiments, the pouring spout fitment also includes attachment means configured to receive a cap. The lid may be selectively attached and removed from the pouring spout fitment, and may serve to close the dispensing opening. In some embodiments, the attachment means are threads. In some embodiments, the attachment means are one or more snapping elements. The lid may be of any suitable design. For example, the lid may be a screw-on closure, a snap on closure, a safety seal, or a hinged cap.

In some embodiments, the pouring spout fitment also includes an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the flexible container through the distal opening when the hollow canoe portion is attached to the inner surface of the flexible container, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the flexible container to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer. In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the detachable dispensing systems with the ability to dispense material from a container into various destinations without having to disconnect the system from the container.

In one embodiment, a user may insert a finger or tool into the distal end of the extendible spout to adjust the extendible spout from one extended length to a second extended length, when desired.

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the pouring spout fitment includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the pouring spout fitment includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the pouring spout fitment includes a handling portion. The handling portion may substantially surround at least a portion of the hollow rigid member. The handling portion may be textured, or contain a plurality of ridges or protrusions to enhance its graspability by the user. In some embodiments, the handling portion may be at the top end of the hollow rigid member.

In some embodiments, the pouring spout fitment includes a removable lid that covers the top end of the hollow rigid member, when the hollow rigid member is in the recessed position. In one embodiment, the removable lid is hingedly connected to the hollow rigid member. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit.

In some embodiments, the removable lid includes one or more sealing flanges configured to form a seal between the removable lid and the hollow member or extendible spout. For example, in some embodiments the removable lid includes a first sealing flange configured to engage the top end of the hollow member to form a seal between the removable lid and the hollow member when the removable lid is in the closed position. In some embodiments, the removable lid includes a second sealing flange configured to engage the distal end of the extendible spout to form a seal between the removable lid and the extendible spout when the removable lid is in a closed position. The two sealing flanges may offer additional security against the leaking or unintended pouring of the contents of the flexible container. Further, the second sealing flange may prevent the contents of the flexible container from leaking onto the exterior of the extendible spout. In this way, the outer surface of the extendible spout, which is likely to be grasped by a user seeking to pour the contents of the flexible container, may be kept clean even if the extendible spout is extended and retracted. In other words, a user may be able to use only a portion of the contents of the flexible container, re-close the package, and still find the extendible spout suitable for use upon re-opening the flexible container. In some embodiments, the flexible container may comprise a hollow friction fitting. In these embodiments, the canoe may be configured to attach to the inner surface of this hollow friction fitting. For example, the canoe may comprise friction fit means, such as ridges and/or barbs which extend from the canoe and are configured to engage the inner surface of the hollow friction fitting. For example, the inner surface of the hollow friction fitting may include a plurality of ridges, valleys, barbs, or depressions which are complementary to the friction fit means on the canoe. In this way, the canoe and the friction fitting may form a seal, such that no material stored within the flexible container can escape through the interface between the hollow friction fitting and the canoe. In some embodiments, the outer diameter of the canoe may be slightly larger than the inner diameter of the hollow friction fitting. In some embodiments, the canoe and the hollow friction fitting may each comprise snapping elements, so that the hollow friction fitting and the canoe form a snap interference fit. As used herein, a "snap interference fit" means a stationary coupling of the hollow friction fitting to the canoe as a result of at least one or more snapping elements.

The hollow friction fitting may be made of any suitable material. In some embodiments, the hollow friction fitting is made of a thermoplastic material. Non-limiting examples of suitable thermoplastic materials include polypropylene, polyethylene, and the like. In some embodiments, the hollow friction fitting is formed by injection molding.

In some embodiments, the pourable material is a fluid. In embodiments, the fluid is a liquid or the combination of a liquid and a gas. Non-limiting examples of suitable fluids include motor oil, and the like. In other embodiments, the pourable material is a flowable solid. Non-limiting examples of suitable flowable solids includes sand, pebbles, and the like. In yet other embodiments, the pourable material is a combination of a fluid and flowable solid.

Friction Pouring Spout Fitments

In some embodiments, the dispensing system is a friction fitment. In some embodiments, the flexible containers include a hollow friction fitting. In some embodiments, the inner surface of the hollow friction fitting may include a plurality of ridges, valleys, barbs, or depressions configured to create a friction fit or a snap interference fit with the friction fitments described herein.

In some embodiments, the friction fitment comprises a hollow rigid member. The hollow rigid member may include a top end, which has a discharge opening, and a base end having a base opening, where the base opening and the discharge opening are in fluid communication with one another. The hollow rigid member may include an outer surface and an inner surface. The outer surface of the hollow rigid member may include a plurality of ridges, valleys, barbs, or depressions configured to create a friction fit or a snap interference fit with the hollow friction fitting of the flexible container. For example, in some embodiments the ridges, valleys, barbs, or depressions on the inner surface of the hollow friction fitting may be complimentary to those on the outer surface of the hollow rigid member. In this way, the hollow rigid member and the friction fitting may form a seal, such that no material stored within the flexible container can escape through the interface between the hollow friction fitting and the hollow rigid member. In some embodiments, the outer diameter of the hollow rigid member may be slightly larger than the inner diameter of the hollow friction fitting. In some embodiments, the hollow rigid member and the hollow friction fitting may each comprise snapping elements, so that the hollow friction fitting and the canoe form a snap interference fit. As used herein, a "snap interference fit" means a stationary coupling of the hollow friction fitting to the hollow rigid member as a result of at least one or more snapping elements.

In some embodiments, the hollow rigid member further includes a rail grabber portion. The rail grabber portion may be located at or near the top end of the hollow rigid member, such that the rail grabber portion extends beyond the flexible container when the friction fitment is attached to the flexible container. In some embodiments, the rail grabber portion substantially surrounds at least a portion of the hollow rigid member. In some embodiments, the rail grabber portion may consist of two or more protrusions which extend outward around a dispensing opening. The rail grabber portion is configured to allow for easy transport of the friction fitment and flexible container with the fitment attached along standard manufacturing lines, according to methods which are known in the art.

The hollow friction fitting may be made of any suitable material. In some embodiments, the hollow friction fitting is made of a thermoplastic material. Non-limiting examples of suitable thermoplastic materials include polypropylene, polyethylene, and the like. In some embodiments, the hollow friction fitting is formed by injection molding.

The hollow rigid member may be made of any suitable material. In some embodiments, the hollow friction fitting is made of a thermoplastic material. Non-limiting examples of suitable thermoplastic materials include polypropylene, polyethylene, and the like. In some embodiments, the hollow friction fitting is formed by injection molding.

In some embodiments, the friction fitment further comprises a handling portion. This handling portion is configured to extend beyond the opening of the flexible container, and substantially surrounds at least a portion of the hollow rigid member. Thus, when the friction fitment has been installed in a flexible container, a user may be able to lift, move, and manipulate the flexible container in party by grasping the handling portion. In some embodiments, the handling portion may include features to improve its graspability by a user. For example, the handling portion may be textured, or include a plurality of ridges or protrusions to make it more easily graspable by a user.

In some embodiments, the friction fitment also includes an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the flexible container through the distal opening when the friction fitment is attached to the flexible container, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the flexible container to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer. In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the friction fitments with the ability to dispense material from a container into various destinations without having to disconnect the system from the container.

In one embodiment, a user may insert a finger or tool into the distal end of the extendible spout to adjust the extendible spout from one extended length to a second extended length, when desired.

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the pouring spout fitment includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the pouring spout fitment includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the friction fitment includes a removable lid that covers the top end of the hollow rigid member, when the hollow rigid member is in the recessed position. In one embodiment, the removable lid is hingedly connected to the hollow rigid member. In one embodiment, the removable lid is hingedly connected to the handling portion. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit.

In some embodiments, the removable lid includes one or more sealing flanges configured to form a seal between the removable lid and the hollow member or extendible spout. For example, in some embodiments the removable lid includes a first sealing flange configured to engage the top end of the hollow member to form a seal between the removable lid and the hollow member when the removable lid is in the closed position. In some embodiments, the removable lid includes a second sealing flange configured to engage the distal end of the extendible spout to form a seal between the removable lid and the extendible spout when the removable lid is in a closed position.

In some embodiments, the pourable material is a fluid. In embodiments, the fluid is a liquid or the combination of a liquid and a gas. Non-limiting examples of suitable fluids include motor oil, and the like. In other embodiments, the pourable material is a flowable solid. Non-limiting examples of suitable flowable solids includes sand, pebbles, and the like. In yet other embodiments, the pourable material is a combination of a fluid and flowable solid.

Illustrated Flexible Containers

FIGS. 1-6 illustrate an exemplary embodiment of a flexible container which includes a dispensing system in various configurations.

FIGS. 1-6 illustrate a flexible container 100 and dispensing system 109 according to an embodiment of the present disclosure. The flexible container 100 includes a front panel 101, a back panel 103, a top panel 105, a bottom panel 107, and a dispensing system 109.

The front panel 101 includes a top horizontal edge portion 101*a*, a bottom horizontal edge portion 101*b*, a first longitudinal edge portion 101*c*, a second longitudinal edge portion 101*d*, a first corner seal portion 101*e*, a second corner seal portion 101*f*, a first top corner seal portion 101*g*, and a second top corner seal portion 101*h*. The front panel 101 further includes an inner surface 101*i* and outer surface 101*o*. The back panel 103 includes a top horizontal edge portion 103*a*, a bottom horizontal edge portion 103*b*, a first longitudinal edge portion 103*c*, a second longitudinal edge portion 103*d*, a first corner seal portion 103*e*, a second corner seal portion 103*f*, a first top corner seal portion 103*g*, and a second top corner seal portion 103*h*. The back panel 103 further includes an inner surface 103*i* and outer surface 103*o*. The top panel 105 includes a first horizontal edge portion 105*a*, a second horizontal edge portion 105*b*, a first longitudinal edge portion 105*c*, a second longitudinal edge portion 105*d*. The top panel 105 further includes an inner surface 105*i* and outer surface 105*o*. The bottom panel 107 includes a first horizontal edge portion 107*a*, a second horizontal edge portion 107*b*, a first longitudinal edge portion 107*c*, a second longitudinal edge portion 107*d*. The bottom panel 107 further includes an inner surface 107*i* and outer surface 107*o*.

The inner surface 101*i* of the front panel 101 is attached to the inner surface 103*i* of the back panel. Specifically, the first longitudinal edge portion 101*c* of the front panel 101 is attached to the first longitudinal edge portion 103*c* of the back panel 103 and the second longitudinal edge portion 101*d* of the front panel 101 is attached to the second longitudinal edge portion 103*d* of the back panel 103.

Further, the inner surface of the front panel 101 is attached to the inner surface of the top panel and the inner surface of the bottom panel. Specifically, the top horizontal edge portion 101*a* of the front panel 101 is attached to the first horizontal edge portion 105*a* of the top panel 105 and the bottom horizontal edge portion 101*b* of the front panel 101 is attached to the first horizontal edge portion 107*a* of the bottom panel 107.

However, the front panel 101 and the back panel 103 are not directly attached along the entire length of their first and second longitudinal edge portions 101*c*, 101*d*, 103*c*, 103*d*. Rather, the outer surface 105*o* of the top panel 105 is first attached to itself along the first and second longitudinal edge portions 105*c*, 105*d*, and similarly the outer surface 107*o* of the bottom panel 107 is first attached to itself along the first and second longitudinal edge portions (105*c*, 105*d*). The inner surfaces 105*i*, 107*i*, of the top panel 105 and bottom panel 107 are then attached directly to the inner surfaces 101*c*, 103*c* of the front panel 101 and the back panel 103. Specifically, the first longitudinal edge portions 105*c*, 107*c* are attached to the first longitudinal edge portions 101*c*, 103*c* of the front panel 101 and the back panel 103 and the second longitudinal edge portions 105*d*, 107*d* are attached to the first longitudinal edge portions 101*d*, 103*d* of the front panel 101 and the back panel 103. As one of skill in the art would readily understand, these parts may be attached in a single step or in multiple steps.

Further, the inner surface 101*i* of the front panel 101 at the first top corner seal portion 101*g* is attached to the inner surface 105*i* of the top panel 105 at the first front corner seal portion 105*e*. The inner surface 101*i* of the front panel 101 at the second top corner seal portion 101*h* is attached to the inner surface 105*i* of the top panel 105 at the second front corner seal portion 105*f*. The inner surface 101*i* of the front panel 101 at the first corner seal portion 101*e* is attached to the inner surface 107*i* of the bottom panel 107 at the first front corner seal portion 107*e*. The inner surface 101*i* of the front panel 101 at the second corner seal portion 101*f* is attached to the inner surface 107*i* of the bottom panel 107 at the second front corner seal portion 107*f*.

Further, the inner surface 103*i* of the back panel 103 at the first top corner seal portion 103*g* is attached to the inner surface 105*i* of the top panel 105 at the first back corner seal portion 105*g*. The inner surface 103*i* of the back panel 103 at the second top corner seal portion 103*h* is attached to the inner surface 105*i* of the top panel 105 at the second back corner seal portion 105*h*. The inner surface 103*i* of the back panel 103 at the first corner seal portion 103*e* is attached to the inner surface 107*i* of the bottom panel 107 at the first back corner seal portion 107*g*. The inner surface 103*i* of the front panel 103 at the second corner seal portion 103*f* is attached to the inner surface 107*i* of the bottom panel 107 at the second back corner seal portion 107*h*.

The inner surfaces 101*i* and 105*i* are further attached along a front seal 117, which extends from the first longitudinal edge portions 101*c*, 105*c* to the second longitudinal edge portions 101*d*, 105*d*. In this way, the top horizontal edge portion 103*a* and first horizontal edge portion 105*a* are not in fluid communication with the pourable material storage area 111.

The flexible container 100 further includes a handle hole 115 which extends through the front panel 101, the top panel 105, and the back panel 103. As illustrated, the handle hole 115 is located above the front seal 117 and within the second top corner seal portions 101*g*, 103*g*, so that the handle hole is not in fluid communication with the pourable material storage area.

Figure 1A:
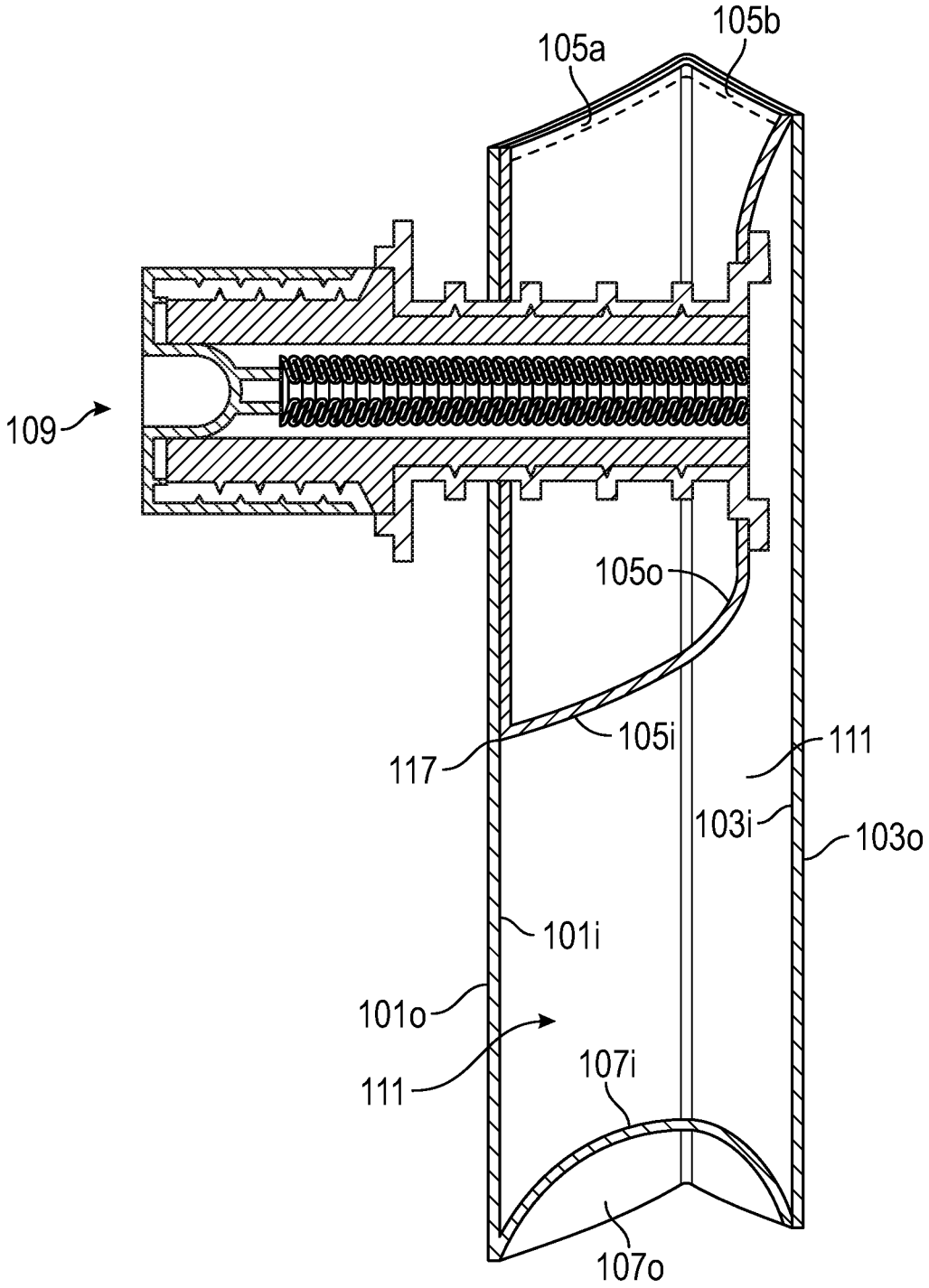
FIG. 1A is a cross-section of the flexible container and dispensing system of FIG. 1, taken along line A-A.
Figure 2:
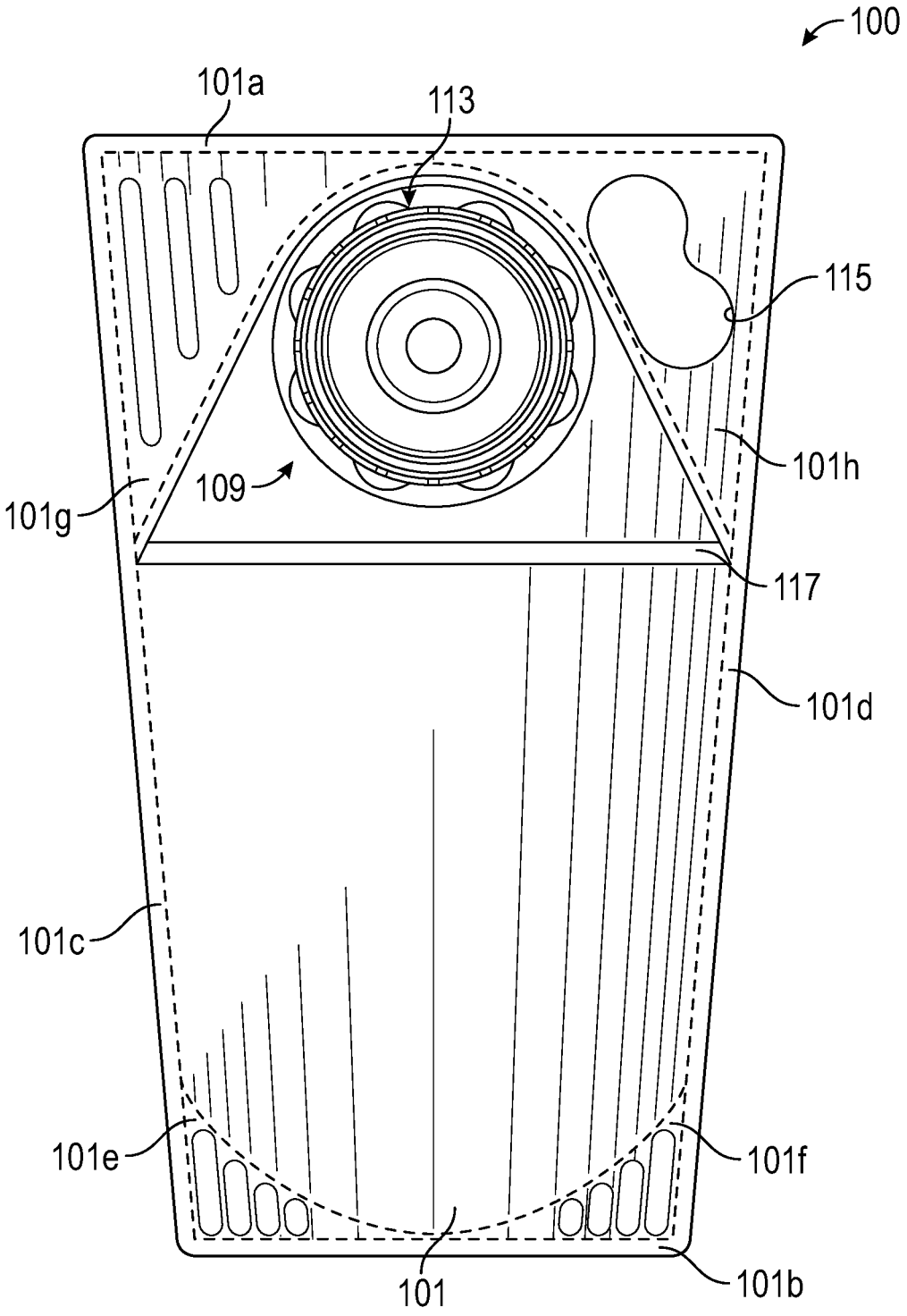
FIG. 2 is a front view of the flexible container and dispensing system of FIG. 1.
Figure 3:
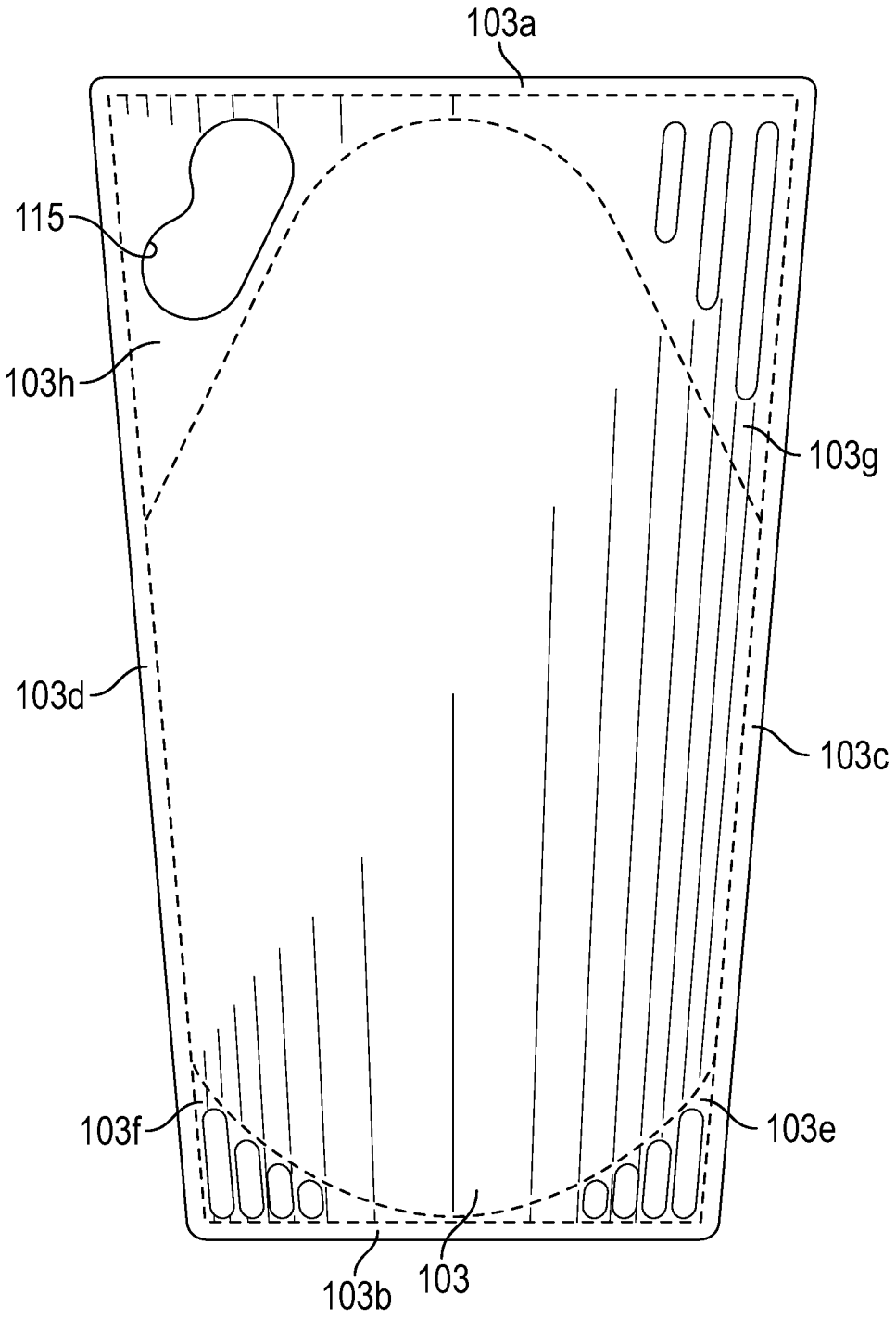
FIG. 3 is a back view of the flexible container and dispensing system of FIG. 1.
Figure 4:
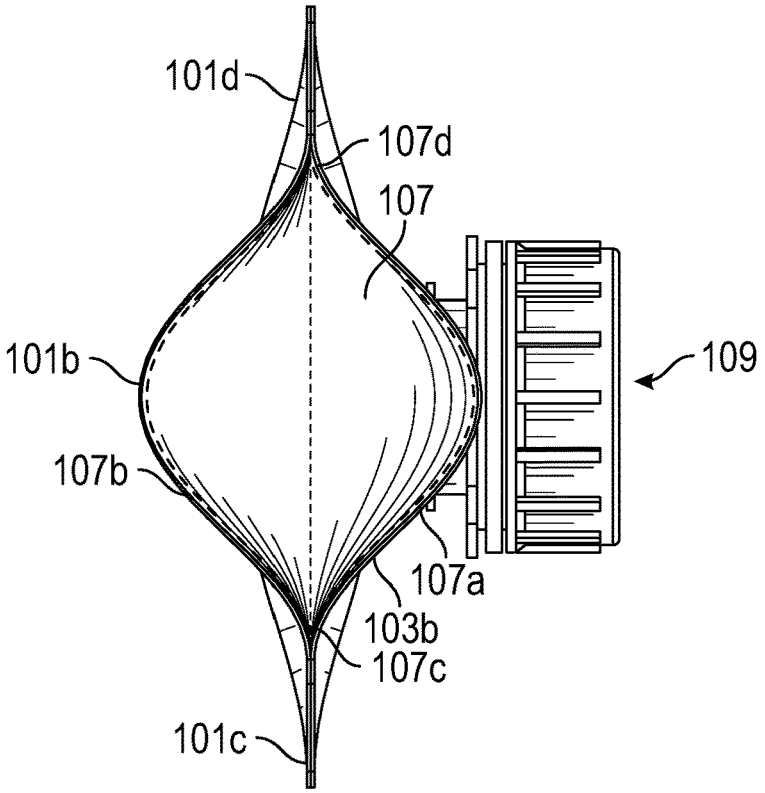
FIG. 4 is a top view of the flexible container and dispensing system of FIG. 1.
Figure 5:
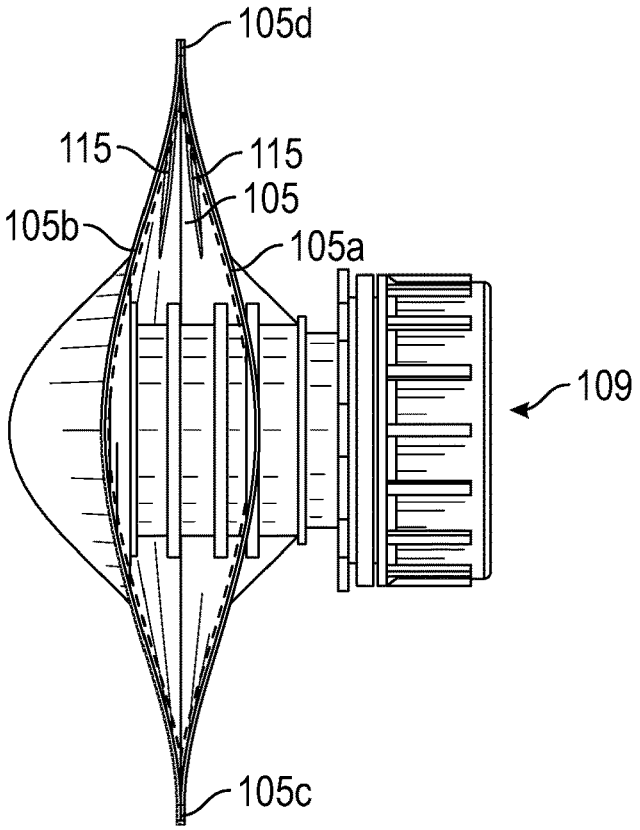
FIG. 5 is a bottom view of the flexible container and dispensing system of FIG. 1.
Figure 6:
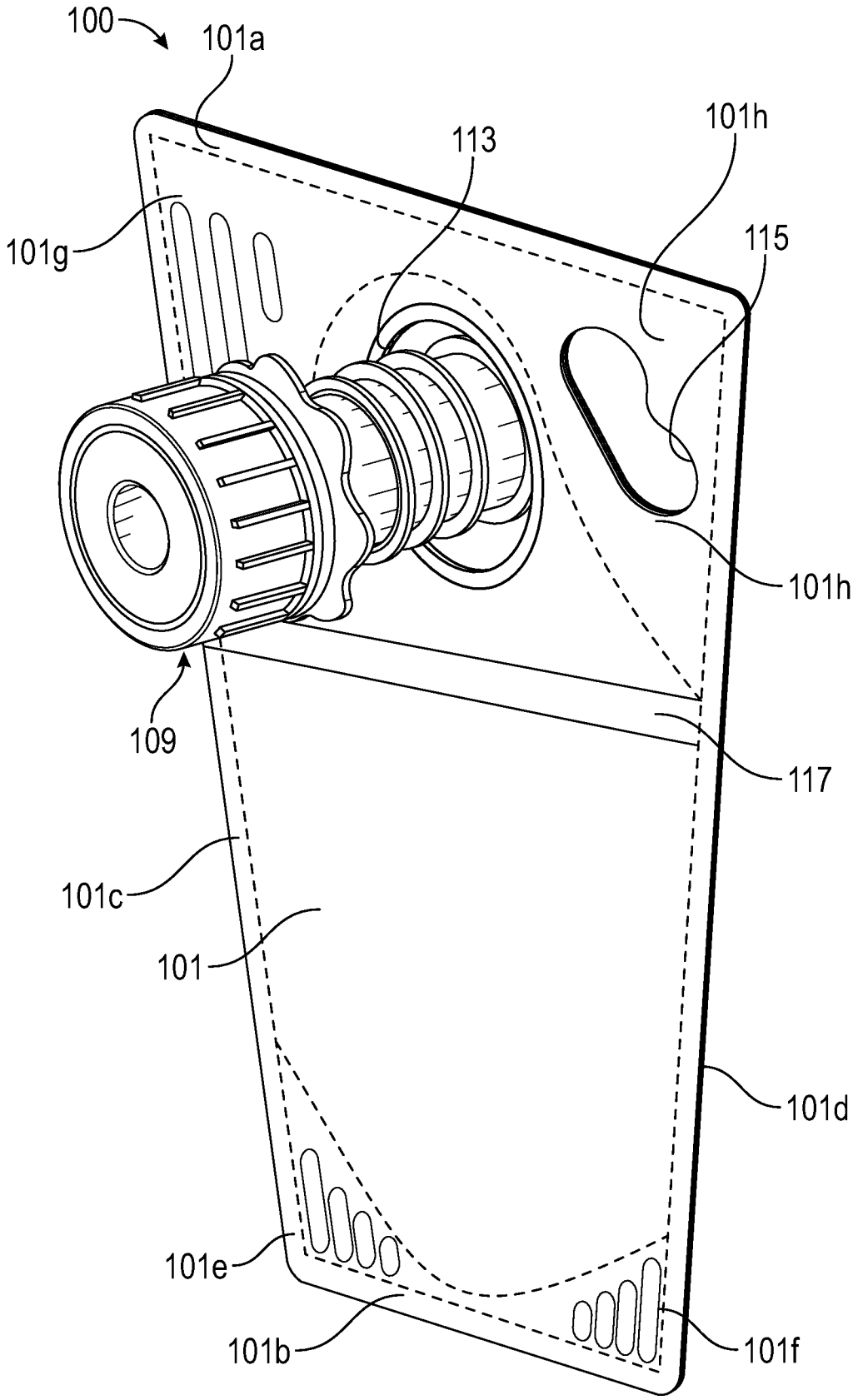
FIG. 6 is a perspective view of the flexible container and dispensing system of FIG. 1, wherein the flexible container is empty.

The flexible container 100 further includes a hole extending through the front panel 101 and the top panel 105 to form a dispensing system passage 113. The dispensing system passage 113 allows the dispensing system 109 to extend through it both when the pourable material storage area 111 is empty and when the pourable material storage area 111 is filled with a fluid or other pourable material As can be seen from these figures, a pourable material storage area 111 is formed between the front panel 101, back panel 103, top panel 105, and bottom panel 107. Specifically, the pourable material storage area 111 is formed by the inner surfaces 101*i*, 103*i*, 105*i*, and 107*i*. Specifically, the pourable material storage area 111 is formed by: the portion of the inner surface 101*i* between the bottom horizontal edge portion 101*b*, the first longitudinal edge portion 101*c*, the second longitudinal edge portion 101*d*, the first corner seal portion 101*e*, the second corner seal portion 101*f*, and the front seal 117; the portion of the inner surface 103*i* between the top horizontal edge portion 103*a*, the bottom horizontal edge portion 103*b*, the first longitudinal edge portion 103*c*, the second longitudinal edge portion 101*d*, the first corner seal portion 103*e*, the second corner seal portion 103*f*, the first top corner seal portion 103*g*, and the second top corner seal portion 103*h*; the portion of the inner surface 105*i* between the front seal 117, the second horizontal edge portion 105*b*, the first longitudinal edge portion 105*c*, the second longitudinal edge portion 105*d*, the first back corner seal portion 105*g*, and the second back corner seal portion 105*h*; and the portion of the inner surface 107*i* between the first horizontal edge portion 107*a*, the second horizontal edge portion 107*b*, the first longitudinal edge portion 107*c*, the second longitudinal edge portion 107*d*, the first front corner seal portion 107*e*, the second front corner seal portion 107*f*, the first back corner seal portion 107*g*, and the second back corner seal portion 105*h*. Thus, the pourable material storage area 111 is not in fluid communication with the dispensing system passage 113 or the handle hole 115. As can be seen in FIG. 1A, however, the dispensing system 109 is attached to the inner surface 105*i* of the top panel 105, the so that the dispensing system 109 is in fluid communication with the pourable material storage area 111.

Illustrated Dispensing Systems and Pouring Spout Fitments

FIGS. 7-13 depict an exemplary embodiment of a dispensing system for use with a flexible container which includes a detachable dispensing system in various configurations.

Figure 7:
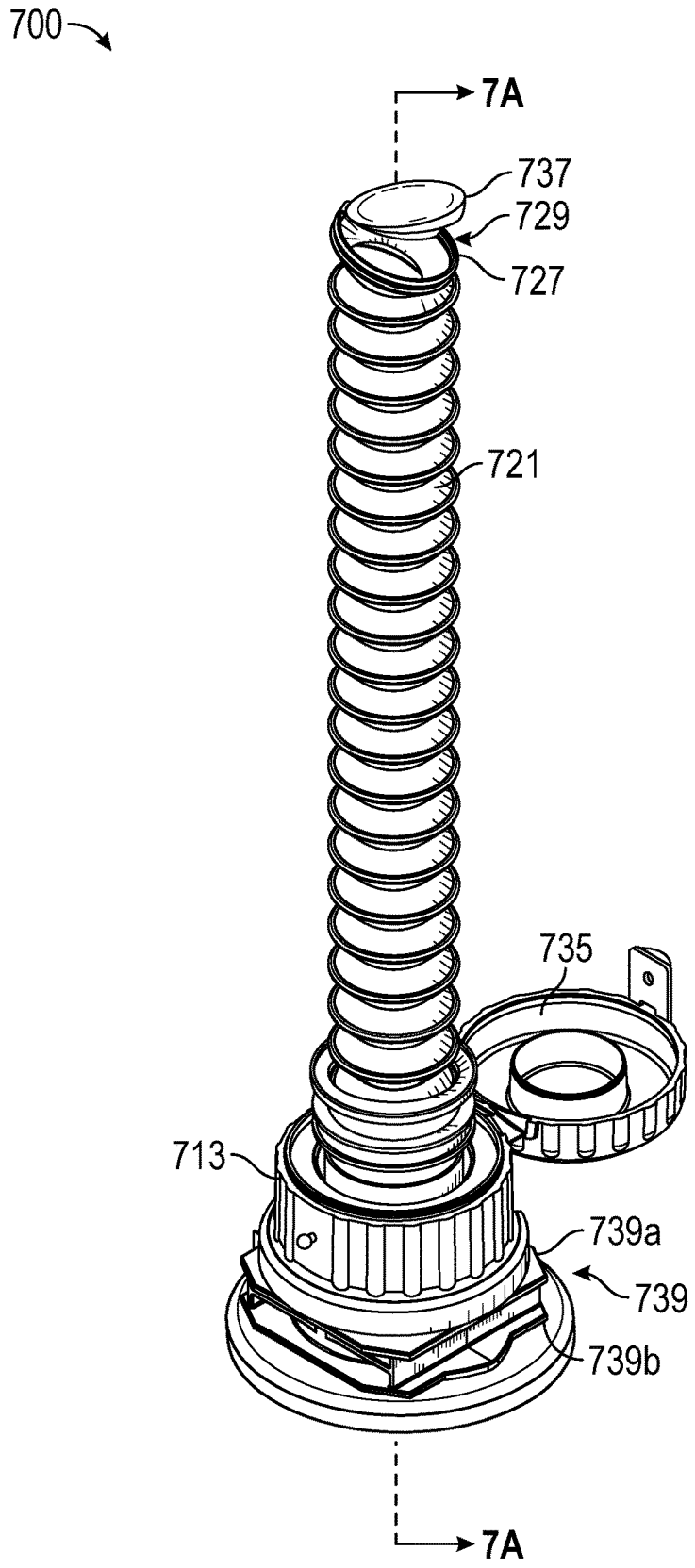
FIG. 7 is a perspective view of a dispensing system including a fitment and a detachable dispensing system disposed in a flexible container.
Figure 7A:
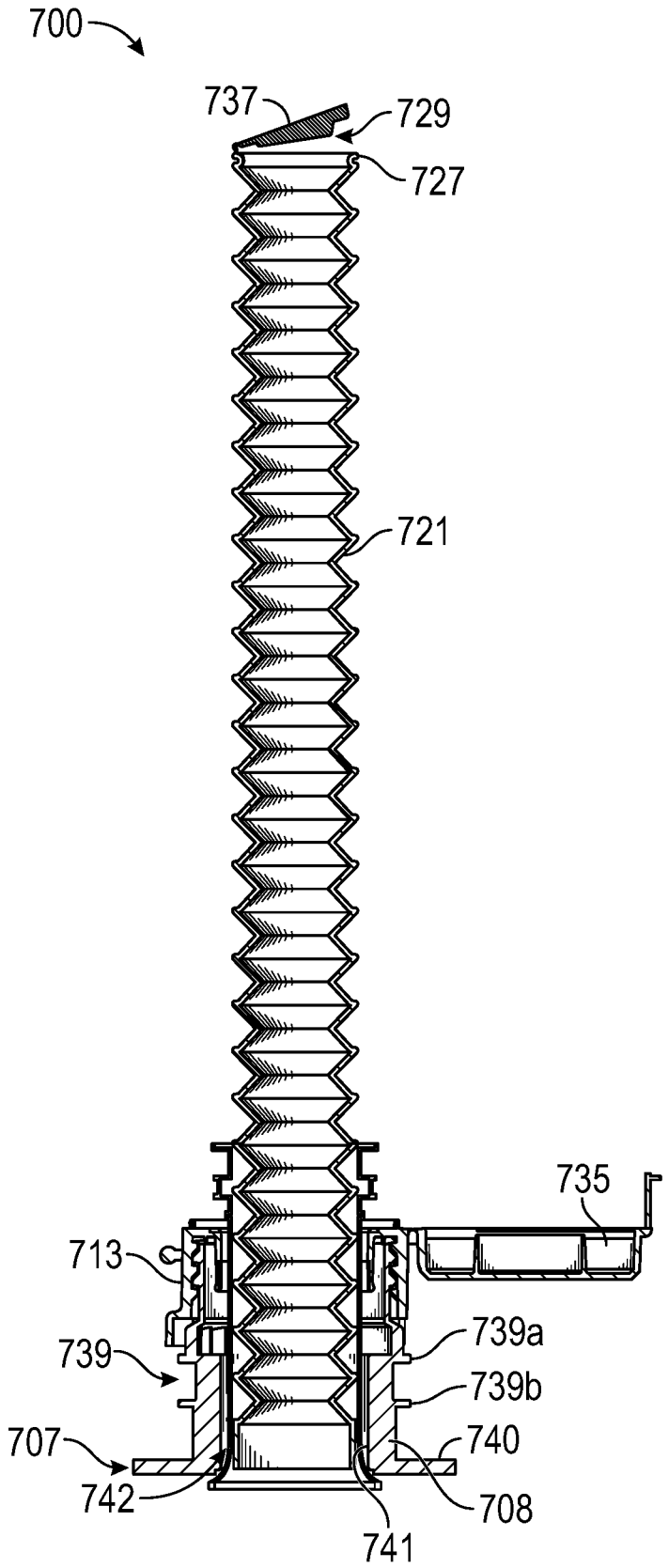
FIG. 7A is a cross-section of the dispensing system of FIG. 7, taken along line 7A-7A.
Figure 8:
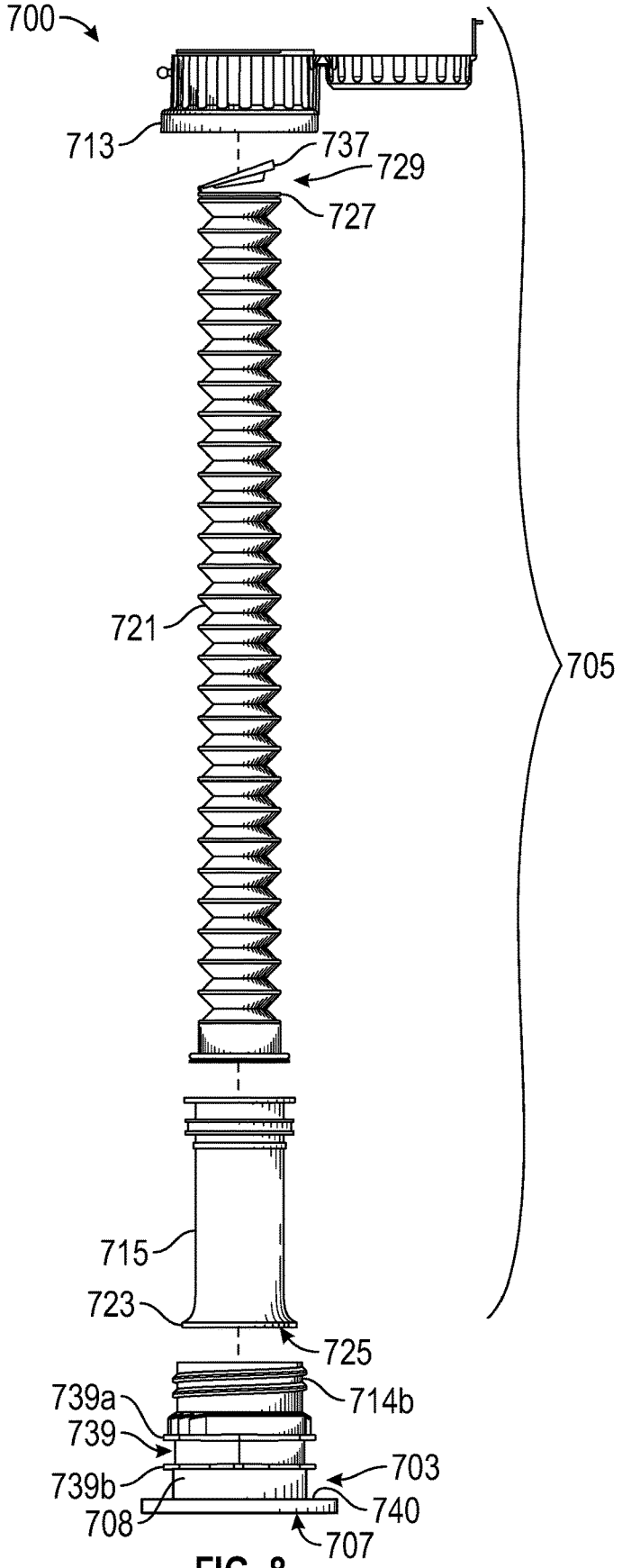
FIG. 8 is an exploded view of the dispensing system of FIG. 1.

FIGS. 7 and 7A illustrate a dispensing system 700 for a flexible container, which includes a fitment 703 and a detachable dispensing system 705. FIG. 8 shows an exploded view of the dispensing system 700 of FIGS. 7 and 7A. The fitment 703 includes a canoe 707 having a body 708 with an outer surface 740 and an inner surface 741 defining a passage 742 extending through the body 708, where the outer surface 741 is configured to be attached to the inner surface of a flexible container. The fitment 703 further includes threads 709 surrounding a dispensing opening 711, wherein the threads 709 are configured to engage the detachable dispensing system 705. The fitment 703 further includes a rail grabber portion 739 consisting of two planar protrusions 739*a* and 739*b*. These protrusions are configured to allow the fitment and a flexible container attached to the fitment 703 to be easily transported along typical manufacturing equipment used in the assembly and filling of flexible containers, according to methods known in the art.

The dispensing system 700 includes a handling portion 713 having an outer ring and an inner ring. The outer ring is configured to selectively secure and, alternatively, remove the handling portion about a dispensing opening 711 of the fitment 703. That is, the outer ring connects the handling portion 713 to the container by connecting threads 714*a* to threads 714*b* on the fitment. The outer ring configuration advantageously enables the handling portion 713, and thus the system, to be attached to and removed from the fitment 703, when desired, rather than being permanently attached.

Figure 9:
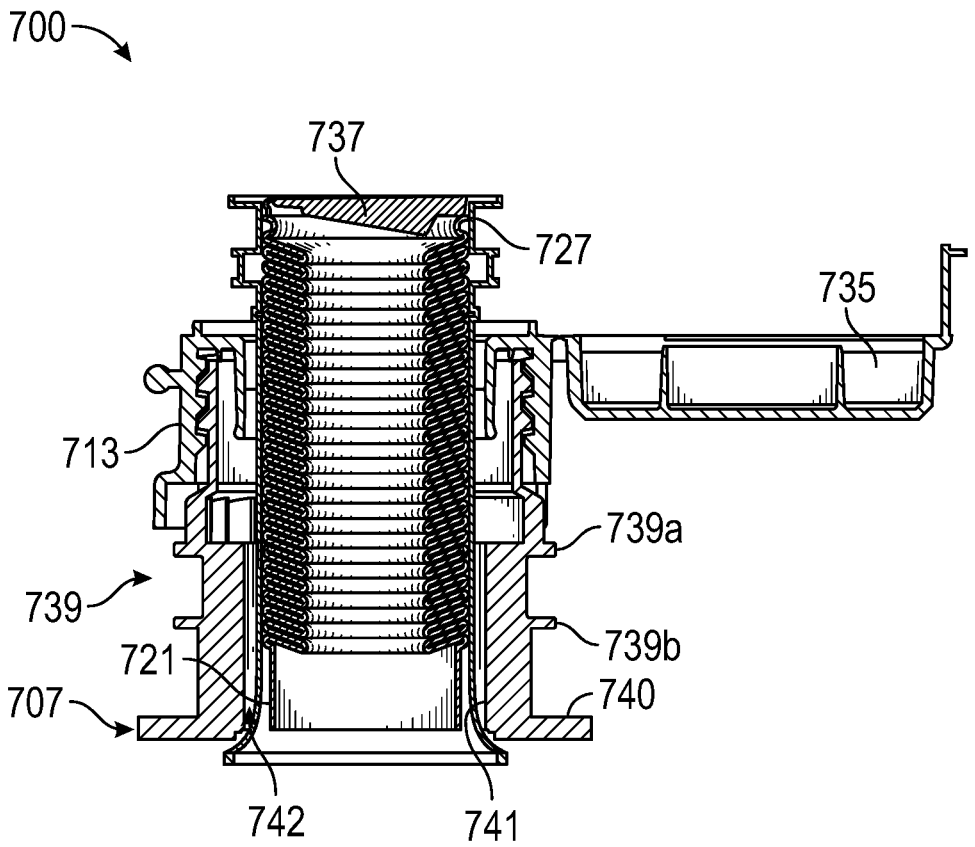
FIG. 9 is a cross-section of the dispensing system and flexible container of FIG. 7 as shown in FIG. 7A, where the extendible spout is shown in a retracted position.

The detachable dispensing system 705 also includes an extendible spout 721 that is at least partially disposed in and connected to the hollow rigid member 715. The extendible spout 721 includes a proximal end 723 and a proximal opening 725, a distal end 727 and a distal opening 729, and a discharge passage 731. The proximal end 713 is connected to the hollow rigid member 715, the distal end 727 is configured to extend from and retract at least partially into the hollow rigid member 715, and the discharge passage 731 extends from the proximal opening 725 to the distal opening 729. The extendible spout 721 is movable from a retracted position, as shown in FIG. 9, and an extended position, as shown in FIGS. 7, 7A, and 8. The extendible spout 721 is configured to dispense the pourable material from a flexible container through the distal opening 729 when the handling portion 713 is engaged about the dispensing opening 711 of the fitment 703.

Figure 10:
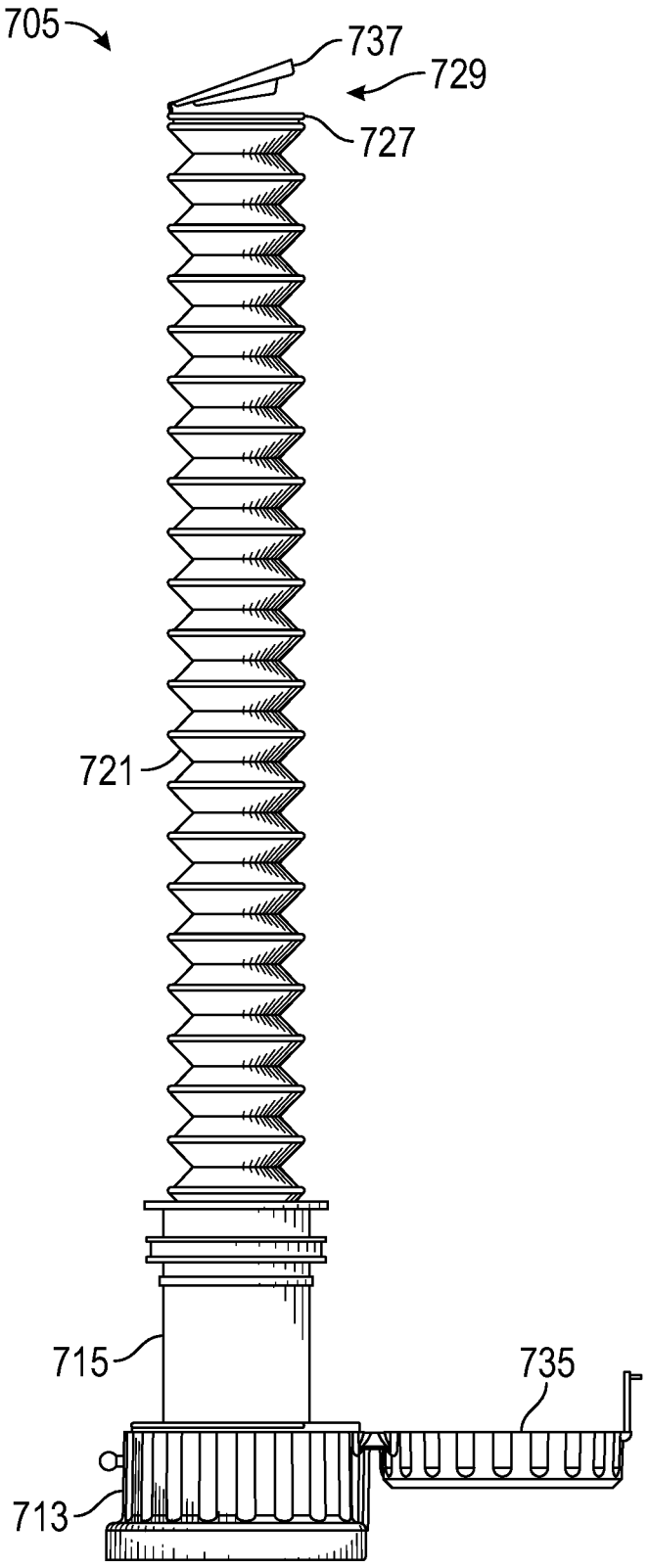
FIG. 10 is another perspective view of the detachable dispensing system of FIG. 7, wherein the hollow rigid member is in an extended position.

The detachable dispensing system 705 also includes a hollow rigid member 715 that includes a top end 717 and a flared base end 719. The hollow rigid member 115 is slideably disposed within the handling portion 713 and selectively positionable between a recessed position and an extended position. FIGS. 7, 7A, 8, and 9 illustrate the dispensing system 700 wherein the hollow rigid member 715 is in a recessed position, wherein the top end 717 is proximate the handling portion 713, and wherein the extendible spout 721 is shown in an extended position. FIG. 10 illustrates the detachable dispensing system wherein the hollow rigid member 715 is in an extended position, wherein the bottom end 719 is proximate the handling portion 713, and wherein the extendible spout 721 is in an extended position.

The dispensing system 700 further includes a safety seal 737 which is attached to the extendible spout 721 in an open configuration, where material can pass through the distal opening 729 of the extendible spout 721. The safety seal 737 is configured to seal the distal opening 729 of the extendible spout 721, and may also function as a pull tab to assist a user in extending the extendible spout 721.

Figure 11:
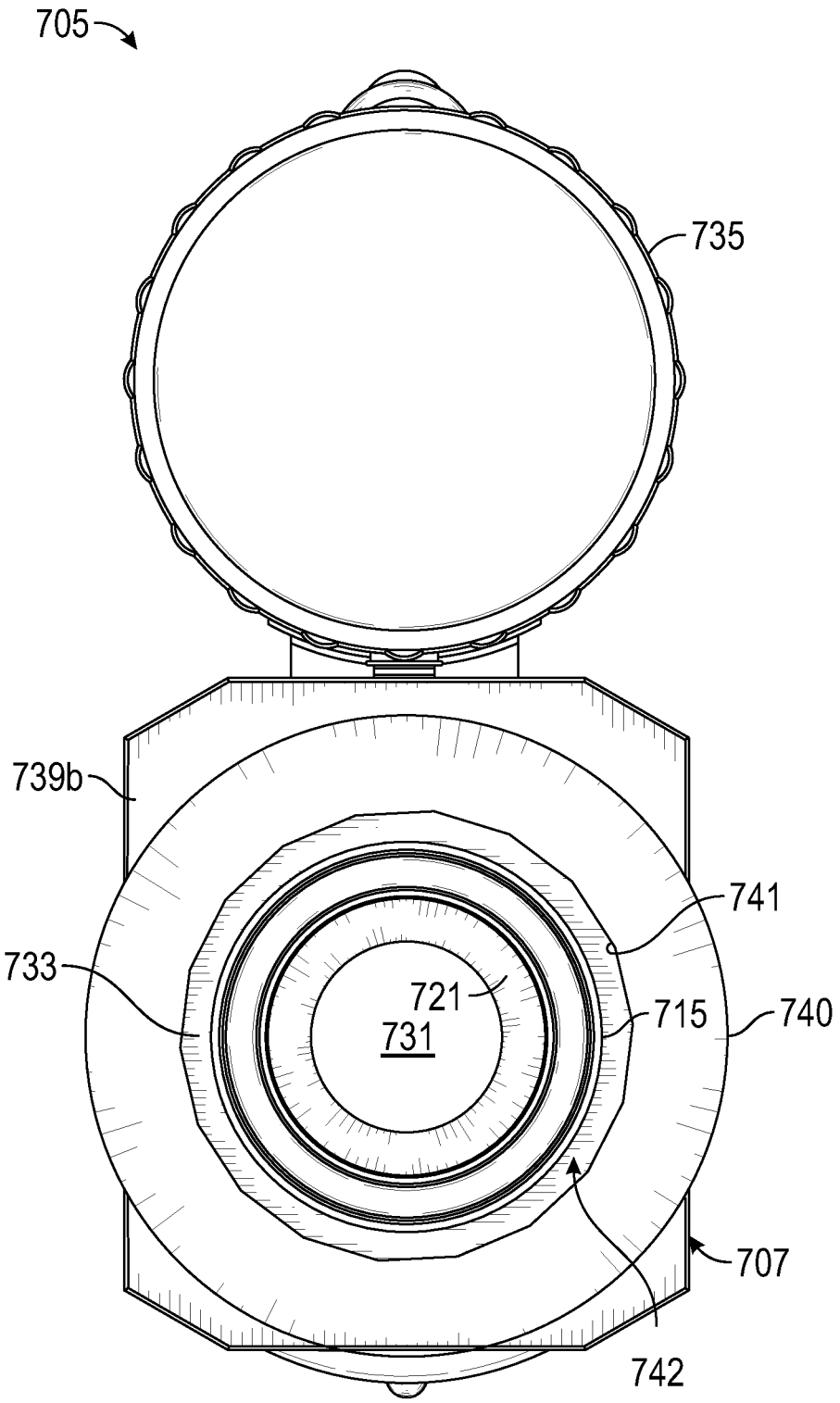
FIG. 11 is a bottom view of the detachable dispensing system of FIG. 7.
Figure 12:
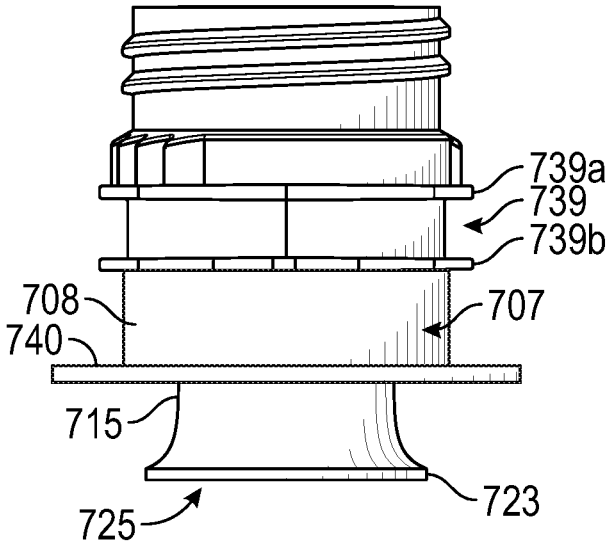
FIG. 12 is a partial perspective view of a portion of the dispensing system of FIG. 7.
Figure 13:
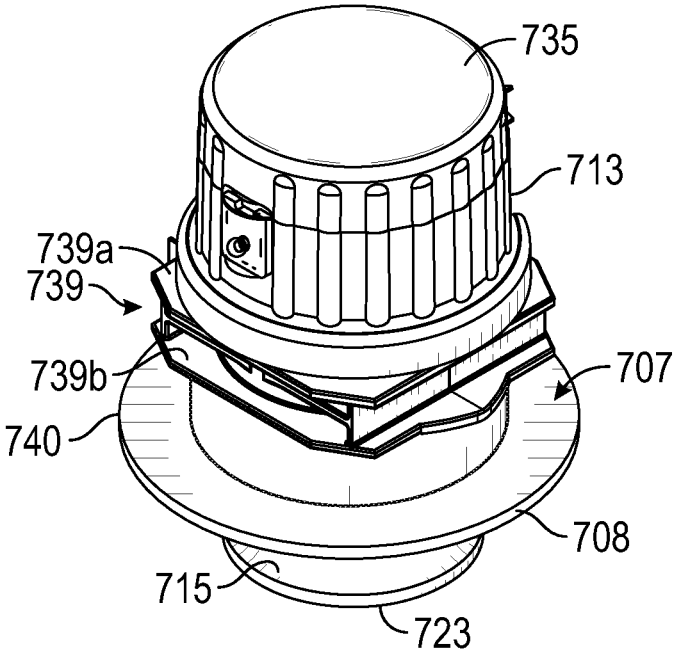
FIG. 13 is a perspective view of the detachable dispensing system of FIG. 7, wherein the removable lid is in a closed position.

FIG. 11 is a bottom view of the dispensing system 700 of FIG. 7. As can be seen in FIG. 11, there may be an annular space 733 created between the hollow rigid member 715 and the canoe 707. FIG. 12 is a partial perspective view of the dispensing system 700 of FIG. 7. As can be seen in FIG. 12, the bottom end 719 of the hollow rigid member 715 may extend farther below than the canoe 707. In other words, the hollow rigid member 715 may extend further into the flexible container than the canoe 707 of the fitment 703. FIG. 13 is a perspective view of the dispensing system 700 wherein the lid 735 is shown in a closed position.

FIGS. 14-17 depict an exemplary embodiment of a pouring spout fitment for use with a flexible container in various configurations.

Figure 14:
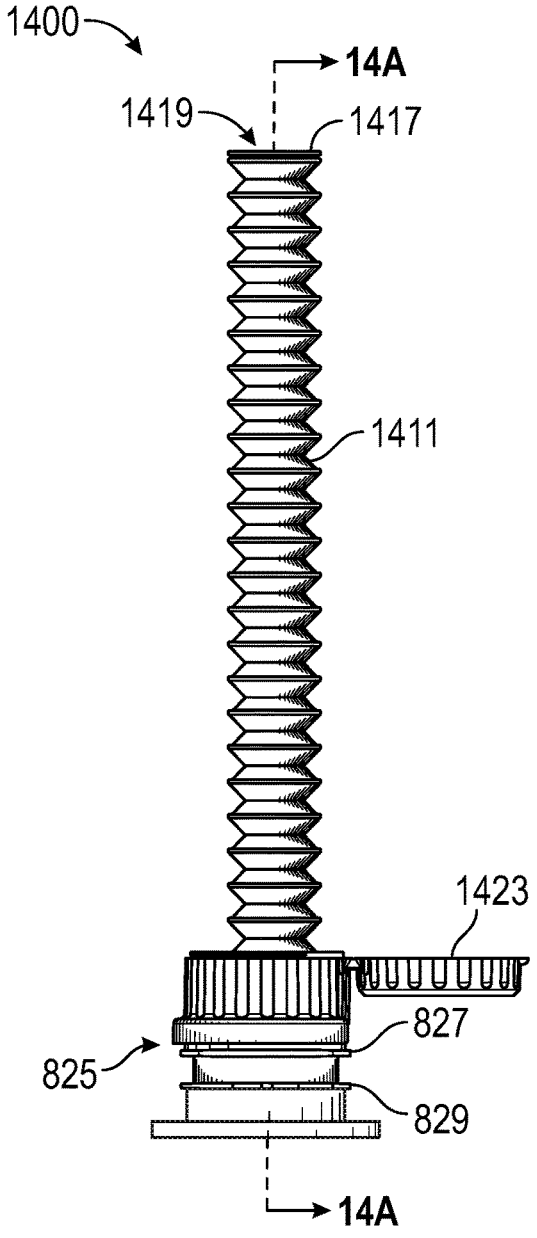
FIG. 14 is a perspective view of an embodiment of a pouring spout fitment.
Figure 14A:
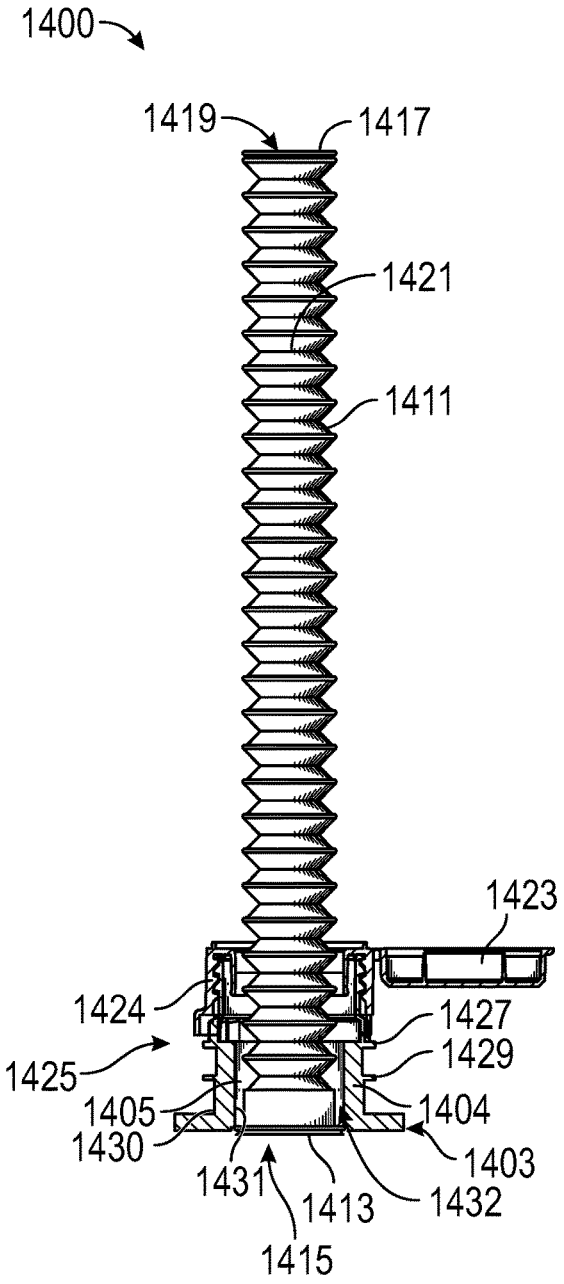
FIG. 14A is a cross-section of the pouring spout fitment of FIG. 8, taken along line 14A-14A.
Figure 15:
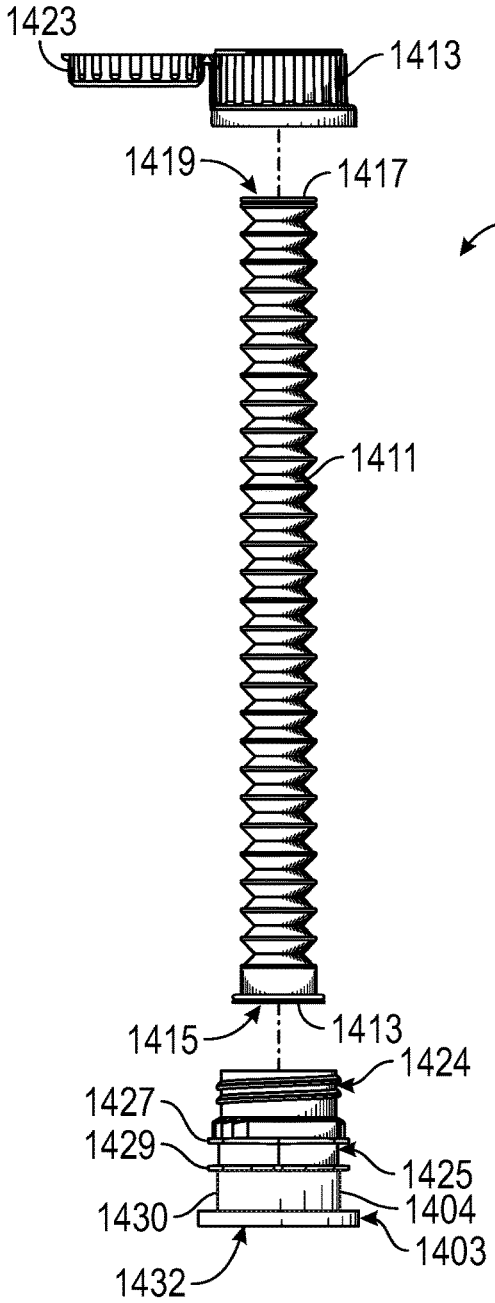
FIG. 15 is an exploded view of the pouring spout fitment and flexible container of FIG. 14.
Figure 16:
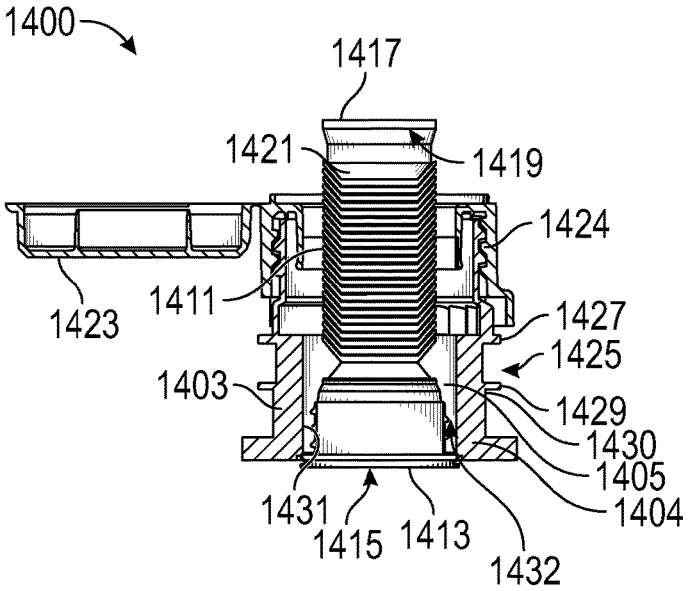
FIG. 16 is a cross-section of the pouring spout fitment of FIG. 14 as shown in FIG. 14A, where the extendible spout is shown in a retracted position.

FIGS. 14 and 14A illustrate pouring spout fitment 1400 for a flexible container, which includes a hollow canoe portion 1403 having a body 1404 with an outer surface 1430 and an inner surface 1431 defining a passage 1432 extending through the body, wherein the outer surface 1430 is configured to be attached directly to the inner surface 1402 of a flexible container 1401. FIG. 15 is an exploded view of the pouring spout fitment 1400 of FIG. 14. For example, the hollow canoe portion 1403 may be welded to the inner surface of a flexible container. The pouring spout fitment 1400 further includes a hollow rigid member 1405 having a top end 1407 and a bottom end 1409. The pouring spout fitment further includes an extendible spout 1411 that is at least partially disposed in and connected to the hollow rigid member 1405. The extendible spout 1411 includes a proximal end 1413 and a proximal opening 1415, a distal end 1417 and a distal opening 1419, and a discharge passage 1421. The proximal end 1413 is connected to the hollow rigid member 1405, the distal end 1417 is configured to extend from and retract at least partially into the hollow rigid member 1405, and the discharge passage 1421 extends from the proximal opening 1415 to the distal opening 1419. The extendible spout is configured to extend between an extended position, wherein the distal end 1417 extends from top end 1407 of the hollow rigid member 1405, and a retracted position, wherein the distal end 1417 retracts at least partially into the hollow rigid member 1405. The extendible spout 1411 is configured to dispense the pourable material from the flexible container through the distal opening 1419 when the hollow canoe portion 1403 is attached to the inner surface of the flexible container. FIGS. 14 and 14A illustrate the extendible spout in an extended configuration. The pouring spout fitment 1400 further includes a removable lid 1423, which is attached to the top end 1407 of the hollow rigid member 1405 by threads 1424.

The pouring spout fitment 1403 further includes a rail grabber portion 1425 consisting of two planar protrusions 1427 and 1429. These protrusions are configured to allow the fitment 1403 and a flexible container 1401 attached to the fitment 1403 to be easily transported along typical manufacturing equipment according to methods known in the art.

Figure 17:
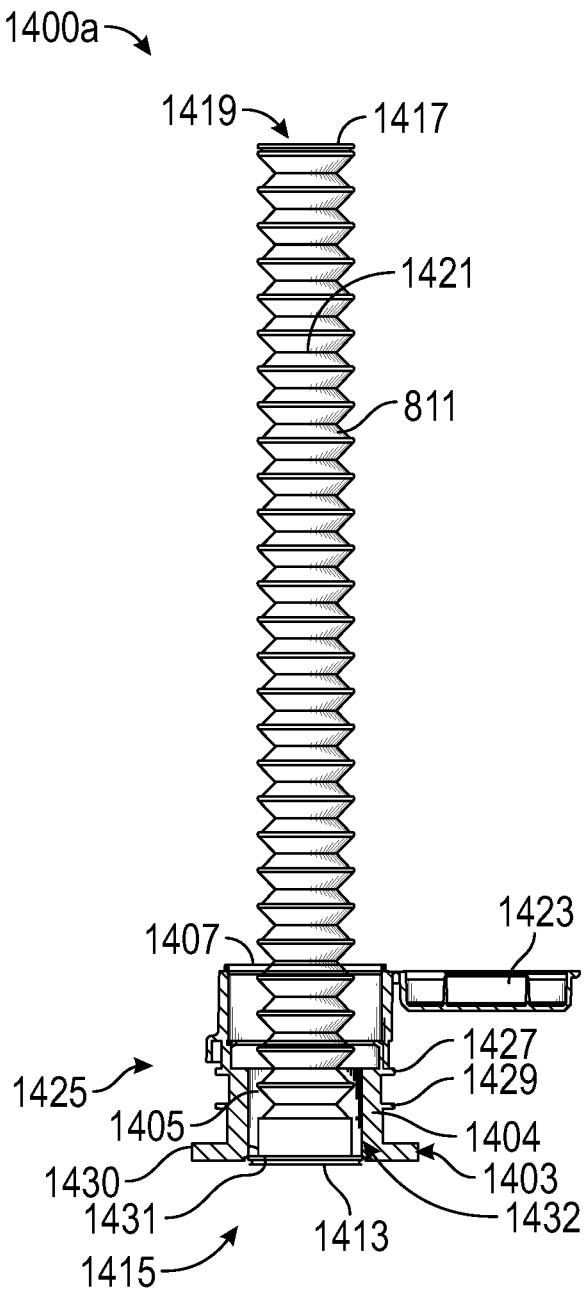
FIG. 17 is a cross-sectional view of a one-piece embodiment of the pouring spout fitment of FIG. 14.

FIG. 17 illustrates an alternate embodiment of the pouring spout fitment 1400, 1400*a*. This embodiment includes a hollow rigid member 1405, a hollow canoe portion 1403, a rail grabber portion 1425, and an extendible spout 1411 as described above. However, in this embodiment the lid 1423*a* is integral with the remainder of the fitment 1400*a*. In this embodiment, the lid 1423*a* may be formed in a single injection molding step, and is hingedly connected to the hollow rigid member 1405, rail grabber portion 1425, and hollow canoe portion 1403.

FIGS. 18-21 depict an exemplary embodiment of a pouring spout fitment with friction fit attachment means for use with a flexible container in various configurations.

Figure 18:
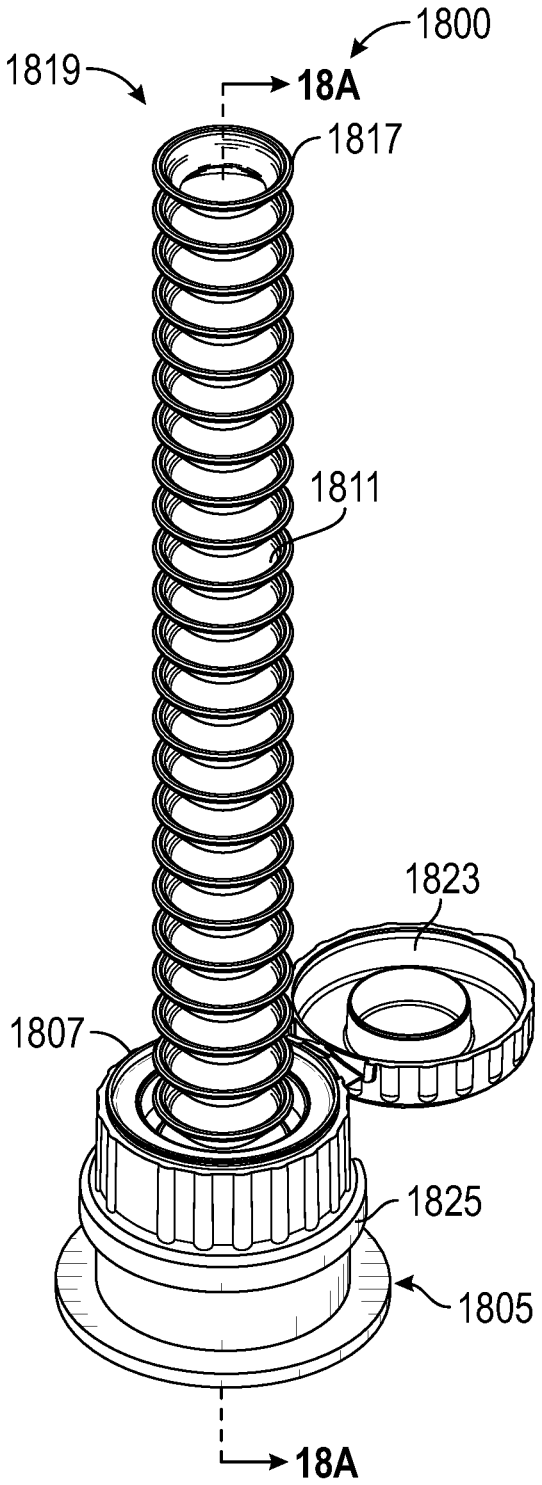
FIG. 18 is a perspective view of an embodiment of a friction pouring spout fitment.
Figure 18A:
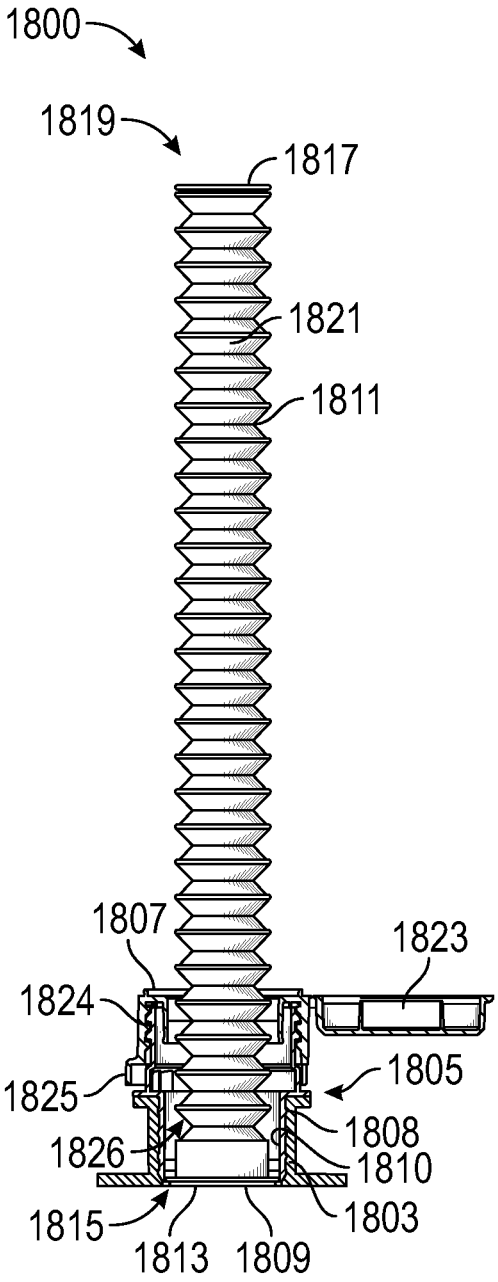
FIG. 18A is a cross-section of the pouring spout fitment and flexible container of FIG. 18, taken along line 18A-18A.
Figure 19:
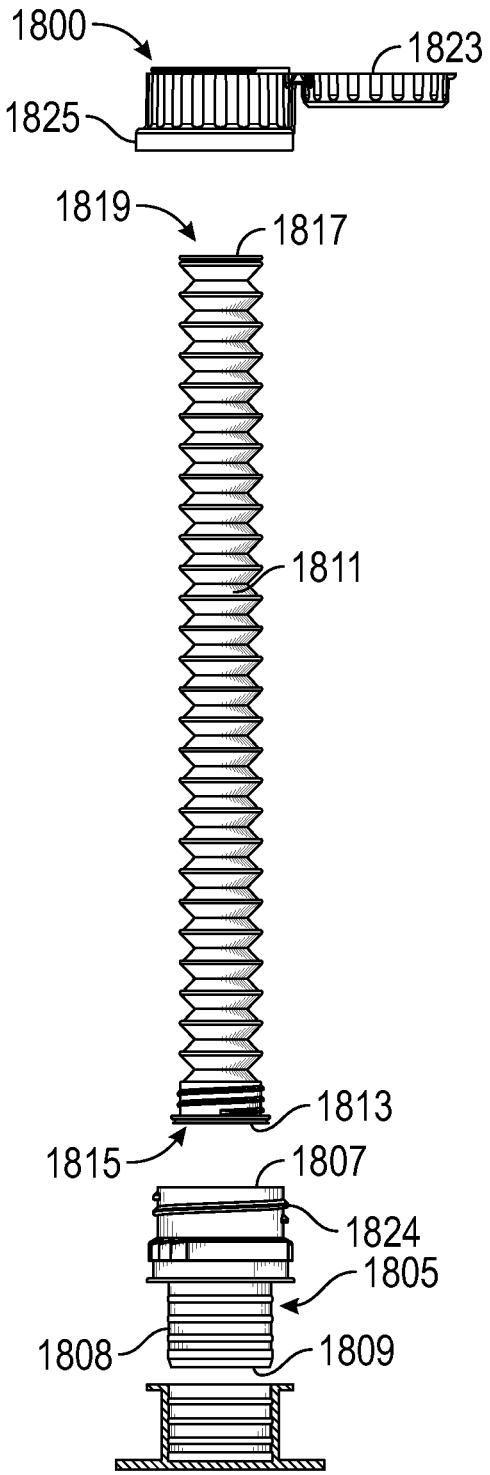
FIG. 19 is an exploded view of the pouring spout fitment and flexible container of FIG. 18.

FIGS. 18 and 18A illustrate pouring spout fitment 1800 for a flexible container. FIG. 18A depicts a cross-sectional view of the pouring spout fitment 1800 of FIG. 18, taken along line 18A-18A. The pouring spout fitment 1800 includes a hollow rigid member 1805 having a top end 1807 and a bottom end 1809, an outer surface 1808, and an inner surface 1810. The pouring spout fitment 1800 further includes an extendible spout 1811 that is at least partially disposed in and connected to the hollow rigid member 1805. The extendible spout 1811 includes a proximal end 1813 and a proximal opening 1815, a distal end 1817 and a distal opening 1819, and a discharge passage 1821. The proximal end 1813 is connected to the hollow rigid member 1805, the distal end 1817 is configured to extend from and retract at least partially into the hollow rigid member 1805, and the discharge passage 1821 extends from the proximal opening 1815 to the distal opening 1819. The extendible spout is configured to extend between an extended position, wherein the distal end 1817 extends from top end 1807 of the hollow rigid member 1805, and a retracted position, wherein the distal end 1817 retracts at least partially into the hollow rigid member 1805. The extendible spout 1811 is configured to dispense the pourable material from a flexible container through the distal opening 1819 when the hollow canoe portion 1803 is attached to the inner surface of a flexible container. FIGS. 18 and 18A, and 19 illustrate the extendible spout in an extended configuration.

The pouring spout fitment 1800 further includes a rail grabber portion 1825 having a single protrusion configured to allow the fitment 1800 and a flexible container attached to the fitment 1800 to be easily transported along typical manufacturing equipment according to methods known in the art. The pouring spout fitment 1800 further includes a removable lid 1823, which is attached to the top end 1807 of the hollow rigid member 1805 by threads 1824.

Figure 20:
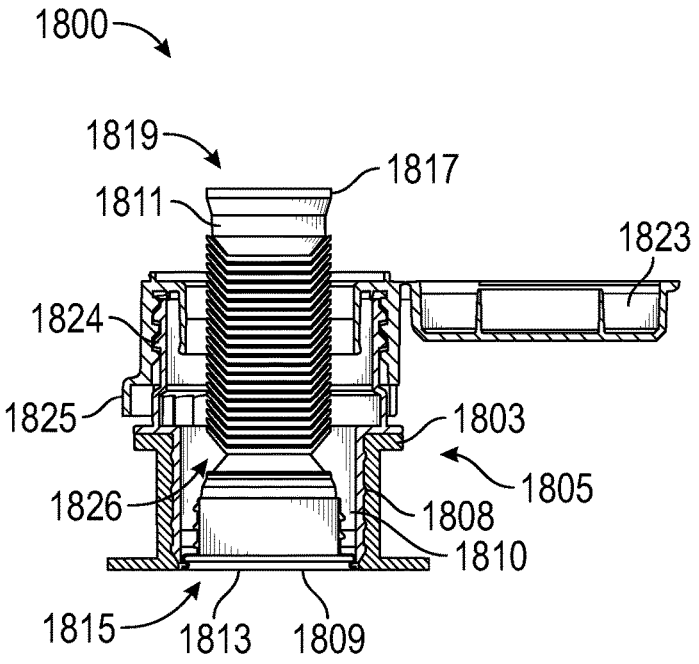
FIG. 20 is a cross-section of the pouring spout fitment and flexible container of FIG. 18 as shown in FIG. 18A, where the extendible spout is shown in a retracted position.

FIG. 20 illustrates a cross-section of the pouring spout fitment 1000 of FIG. 18 as shown in FIG. 18A, where the extendible spout is shown in a retracted position.

Figure 21:
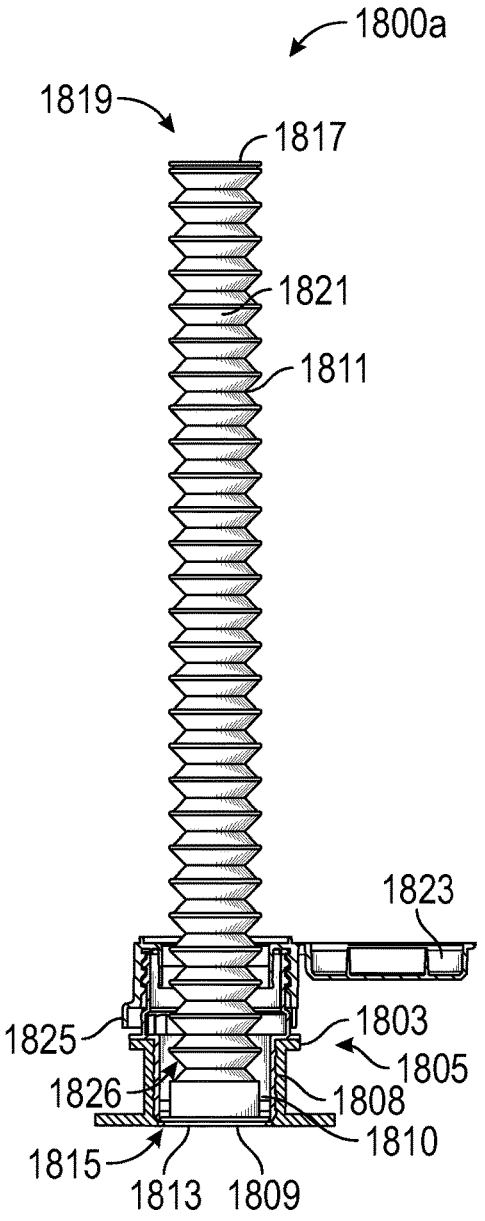
FIG. 21 is a cross-sectional view of a one-piece embodiment of the pouring spout fitment of FIG. 18.

FIG. 21 illustrates an alternate embodiment of the pouring spout fitment 1800, 1800*a*. This embodiment includes a hollow rigid member 1805, a hollow canoe portion 1803, a rail grabber portion 1825, and an extendible spout 1811 as described above. However, in this embodiment the lid 1823*a* is integral with the remainder of the fitment 1800*a*. In this embodiment, the lid 1823*a* may be formed in a single injection molding step, and is hingedly connected to the hollow rigid member 1805, rail grabber portion 1825, and hollow canoe portion 1803.

It should be apparent that the foregoing relates only to certain embodiments of the present disclosure and that numerous changes and modifications may be made herein without departing from the spirit and the scope of the disclosure as defined by the appended claims and equivalents thereof.

What is claimed is:

1. A flexible container comprising:

a front panel having an inner surface and an outer surface, a first longitudinal edge portion, a second longitudinal edge portion, a top horizontal edge portion, and a bottom horizontal edge portion;

a back panel having an inner surface and an outer surface, wherein an edge of the inner surface of the back panel is attached to an edge of the inner surface of the front panel, a first longitudinal edge portion, a second longitudinal edge portion, a top horizontal edge portion, and a bottom horizontal edge portion;

a bottom panel having an inner surface and an outer surface, a first longitudinal edge portion, a second longitudinal edge portion, a first horizontal edge portion, and a second horizontal edge portion, wherein an edge of the inner surface of the bottom panel is attached to an edge of the inner surface of the front panel and the inner surface of the back panel, such that at least a portion of the bottom panel extends between the front panel and the back panel;

a top panel having an inner surface and an outer surface, a first longitudinal edge portion, a second longitudinal edge portion, a first horizontal edge portion, and a second horizontal edge portion, wherein an edge of the inner surface of the top panel is attached to an edge of the inner surface of the front panel and an edge of the inner surface of the back panel, such that at least a portion of the top panel extends between the front panel and the back panel opposite the bottom panel, wherein the inner surfaces of the front panel, the back panel, the bottom panel, and the top panel form a pourable material storage area, wherein the front panel and the top panel comprise a hole in the front panel and the top panel to form a dispensing system passage, wherein the dispensing system passage is not in fluid communication with the pourable material storage area; and a dispensing system in fluid communication with the pourable material storage area and attached to the top panel between the top panel and the back panel and extending through the dispensing system passage.

2. The flexible container of claim 1, wherein the inner surfaces of the front panel and the top panel are sealed at a spaced apart distance from the top horizontal edge portion of the top panel to form a front seal, and wherein the hole is between the top horizontal edge portion of the top panel and the front seal.

3. The flexible container of claim 1, wherein:

the top horizontal edge portion of the front panel is attached to the first horizontal edge portion of the top panel, the top horizontal edge portion of the back panel is attached to the second horizontal edge portion of the top panel, the first longitudinal edge portion of the front panel is attached to the first longitudinal edge portion of the back panel, the second longitudinal edge portion of the front panel is attached to the second longitudinal edge portion of the back panel, the bottom horizontal edge portion of the front panel is attached to the first horizontal edge portion of the bottom panel, and the bottom horizontal edge portion of the back panel is attached to the second horizontal edge portion of the bottom panel.

4. The flexible container of claim 1, wherein the first longitudinal edge portion of the outer surface of the bottom panel and the second longitudinal edge portion of the outer surface of the bottom panel are attached.

5. The flexible container of claim 1, wherein the first longitudinal edge portion of the outer surface of the top panel and the second longitudinal edge portion of the outer surface of the top panel are attached.

6. The flexible container of claim 1, wherein the front panel further comprises:

a first corner seal portion extending between the first longitudinal edge portion and the bottom horizontal edge portion of the front panel, and a second corner seal portion extending between the second longitudinal edge portion and the bottom horizontal edge portion of the front panel, wherein the inner surface of the front panel is attached to the inner surface of the bottom panel at each of the first corner seal portion and the second corner seal portion of the front panel.

7. The flexible container of claim 1, wherein the back panel further comprises:

a first corner seal portion extending between the first longitudinal edge portion and the bottom horizontal edge portion of the back panel, and a second corner seal portion extending between the second longitudinal edge portion and the bottom horizontal edge portion of the back panel, wherein the inner surface of the back panel is attached to the inner surface of the bottom panel at each of the first corner seal portion and the second corner seal portion of the back panel.

8. The flexible container of claim 6, wherein the corner seal portions are configured such that, when the pourable material storage area is filled with a fluid, the bottom horizontal edge portion of the front panel and the bottom horizontal edge portion of the back panel form an elliptical shape.

9. The flexible container of claim 1, wherein the front panel further comprises:

a first top corner seal portion extending between the first longitudinal edge portion and the top horizontal edge portion of the front panel, and a second top corner seal portion extending between the second longitudinal edge portion and the top horizontal edge portion of the front panel, wherein the inner surface of the front panel is attached to the inner surface of the top panel at each of the first top corner seal portion and the second top corner seal portion of the front panel.

10. The flexible container of claim 1, wherein the back panel further comprises:

a first top corner seal portion extending between the first longitudinal edge portion and the bottom horizontal edge portion of the back panel, and a second top corner seal portion extending between the second longitudinal edge portion and the bottom horizontal edge portion of the back panel, wherein the inner surface of the back panel is attached to the inner surface of the top panel at each of the first corner seal portion and the second corner seal portion of the back panel.

11. The flexible container of claim 1, wherein each of the front panel, the back panel, the top panel, and the bottom panel comprises a multilayer flexible film.

12. The flexible container of claim 1, wherein each of the front panel, the back panel, the top panel, and the bottom panel comprises a flexible plastic.

13. The flexible container of claim 1, wherein the dispensing system comprises:

(1) a fitment comprising:

a canoe comprising a body having an outer surface and an inner surface defining a passage extending through the body, wherein the outer surface of the canoe is configured to be attached to the inner surface of the top panel;

an engaging element attached to the canoe and surrounding a dispensing opening and configured to engage a detachable dispensing system; and (2) a detachable dispensing system comprising:

a handling portion comprising an outer ring configured to selectively secure and remove the handling portion about the engaging element and an inner ring defining a circular aperture within the handling portion;

a hollow rigid member comprising a top end and a base end, wherein the hollow rigid member is slideably disposed within the circular aperture and selectively positionable between a recessed position and an extended position, wherein:

the top end of the hollow rigid member comprises a first engaging element for engaging at least a portion of the inner ring of the handling portion and preventing the top end of the hollow rigid member from moving through the handling portion into the container when the hollow rigid member is in the recessed position, the base end of the hollow rigid member comprises a second engaging element, which comprises first one or more peripheral elements that extend outwardly from the hollow rigid member, for engaging at least a portion of the inner ring of the handling portion and fixing the hollow rigid member to the handling portion when the hollow rigid member is in the extended position, when the hollow rigid member is in the recessed position, the top end of the hollow rigid member is proximate the handling portion and the base end of the hollow rigid member extends away from the handling portion and toward the container, and when the hollow rigid member is in the extended position, the base end of the hollow rigid member is proximate the handling portion and the top end of the hollow rigid member extends away from the handling portion and the container; and an extendible spout at least partially disposed in the hollow rigid member and connected to the hollow rigid member, the extendible spout comprising:

a proximal end and a proximal opening, the proximal end connected to the hollow rigid member, a distal end and a distal opening, the distal end configured to extend from and retract at least partially into the hollow rigid member, and a discharge passage that extends from the proximal opening to the distal opening, wherein the extendible spout is configured to dispense a pourable material from the container through the distal opening when the handling portion is engaged about the dispensing opening of the container.

14. The flexible container of claim 13, wherein the dispensing system further comprises a removable lid configured to attach to the handling portion and configured to cover the top end of the hollow rigid member when the hollow rigid member is in the recessed position.

15. The flexible container of claim 13 wherein the canoe is configured to be welded or glued to the inner surface of the top panel.

16. The flexible container of claim 14, wherein the removable lid further comprises:

a first sealing flange which engages with the top end of the hollow member to form a seal between the removable lid in the closed position and the hollow member; and a second sealing flange which engages with the distal end of the extendible spout to form a seal between the removable lid in the closed position and the extendible spout.

17. The flexible container of claim 1, wherein the dispensing system comprises a fitment comprising:

(1) a hollow canoe portion having an outer surface and an inner surface defining a passage extending through the body, wherein the canoe is configured to be attached to an inner surface of the flexible container;

(2) a hollow rigid member at least partially disposed within the hollow canoe portion, the hollow rigid member comprising a top end having a discharge opening and a base end, the base end extending from the hollow canoe portion toward the flexible container;

(3) an extendible spout at least partially disposed in the hollow rigid member and connected to the hollow rigid member, the extendible spout comprising:

a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening, wherein the extendible spout is configured to dispense a pourable material from the flexible container through the distal opening when the hollow canoe portion is attached to the inner surface of the flexible container.

18. The flexible container of claim 17, wherein the hollow rigid member further comprises a removable lid adapted to removably cover the discharge opening of the hollow rigid member.

19. The flexible container of claim 1, wherein the dispensing system comprises a pouring spout fitment:

(1) a hollow rigid member comprising a top end having a discharge opening and a base end having a base end opening, an inner surface defining an inner space extending between the discharge opening and the base end opening, and an outer surface, wherein the outer surface comprises friction fit attachment means configured to attach to a friction fit opening in the flexible container;

(2) an extendible spout at least partially disposed in the hollow rigid member and connected to the hollow rigid member, the extendible spout comprising:

a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening, wherein the extendible spout is configured to dispense a pourable material from the container through the distal opening when the hollow rigid member is attached to the friction fit opening.

20. The flexible container of claim 19, wherein the flexible container further comprises a hollow friction fitting attached to the inner surface of the top panel.

21. The flexible container of claim 19, wherein the hollow friction fitting is configured to be welded or glued to the inner surface of the top panel.

22. The flexible container of claim 19, wherein the outer surface of the hollow canoe portion is configured to be attached to the inner surface of the hollow friction fitting.

23. The flexible container of claim 1, wherein, when the pourable material storage area is filled with a fluid, the dispensing system does not horizontally extend beyond a vertical plane tangential to the outer surface of the front panel by more than about 1.5 inches.

24. The flexible container of claim 1, wherein, when the pourable material storage area is filled with a fluid, the dispensing system does not horizontally extend beyond a vertical plane tangential to the outer surface of the front panel.

25. The flexible container of claim 1, further comprising a second hole extending through the front panel, the back panel, and the top panel configured to form a handle capable of accepting the fingers of a user, wherein the second hole is not in fluid communication with the pourable material storage area.

26. The flexible container of claim 25, wherein:

the front panel further comprises:

a first top corner seal portion extending between the first longitudinal edge portion and the top horizontal edge portion of the front panel, and a second top corner seal portion extending between the second longitudinal edge portion and the top horizontal edge portion of the front panel, wherein the inner surface of the front panel is attached to the inner surface of the top panel at each of the first top corner seal portion and the second top corner seal portion of the front panel;

the back panel further comprises:

a first top corner seal portion extending between the first longitudinal edge portion and the bottom horizontal edge portion of the back panel, and a second top corner seal portion extending between the second longitudinal edge portion and the bottom horizontal edge portion of the back panel, wherein the inner surface of the back panel is attached to the inner surface of the top panel at each of the first corner seal portion and the second corner seal portion of the back panel; and the second hole extends through the second top corner seal portion of the front panel and the second top corner seal portion of the back panel.

27. The flexible container of claim 1, wherein one or more of the top panel, the bottom panel, the front panel, and the back panel are attached to each other by gluing, welding, or combinations thereof.

* * * * *